US005165721A

United States Patent [19]

Schwartz

[11] Patent Number: 5,165,721

[45] **Date of Patent: * Nov. 24, 1992**

[54] WINDOWING ATTACHMENT FOR A BOOK

[75] Inventor: David C. Schwartz, Southboro, Mass.

[73] Assignee: Productive Environments, Inc., Southboro, Mass.

[ * ] Notice: The portion of the term of this patent subsequent to Sep. 17, 2008 has been disclaimed.

[21] Appl. No.: 580,942

[22] Filed: Sep. 11, 1990

Related U.S. Application Data

[63] Continuation-in-part of Ser. No. 557,157, Jul. 20, 1990, abandoned, which is a continuation-in-part of Ser. No. 505,912, Apr. 9, 1990, abandoned.

[51] Int. Cl.[5] ..... B42D 1/00

[52] U.S. Cl. ..... 281/15.1; 281/16; 281/51

[58] Field of Search ..... 402/73, 75, 74, 80 R, 402/501; 281/15.1, 31, 37, 38, 45, 46, 47, 48, 16; 462/12, 19

[56] References Cited

U.S. PATENT DOCUMENTS

| | | | |
|---|---|---|---|
| 383,543 | 5/1888 | Rigby | 281/16 |
| 408,260 | 8/1889 | Pratt | 281/16 |
| 432,700 | 7/1890 | Gregg | 281/16 |
| 1,256,868 | 2/1918 | Bergendahl | 462/19 |
| 2,190,438 | 2/1940 | Vogt | 281/2 |
| 2,467,656 | 4/1949 | Broughton | 281/19 |
| 2,541,735 | 2/1951 | Albrecht, Jr. | 281/42 |
| 2,687,313 | 8/1954 | Pisano | 281/42 |
| 2,848,163 | 8/1958 | Serrell | 402/79 X |
| 3,565,462 | 2/1971 | Gottlieb | 281/38 X |
| 4,479,733 | 10/1984 | Segal | 402/501 X |
| 4,838,724 | 6/1989 | Spence, Jr. | 402/79 |
| 4,840,406 | 6/1989 | Pitts | 402/501 X |
| 4,848,948 | 7/1989 | Pitts | 402/79 X |
| 4,940,353 | 7/1990 | Osono et al. | 402/79 |
| 4,981,386 | 1/1991 | Beleckis | 402/73 |
| 5,048,869 | 9/1991 | Schwartz | 281/16 |

FOREIGN PATENT DOCUMENTS

| | | | |
|---|---|---|---|
| 1022036 | 2/1953 | France | 402/79 |
| 100173 | 6/1982 | Japan | 402/79 |
| 887490 | 8/1953 | Netherlands | 402/501 |
| 215159 | 9/1967 | Sweden . | |
| 1115040 | 9/1984 | U.S.S.R. . | |
| 643124 | 9/1950 | United Kingdom | 402/79 |
| 975183 | 11/1964 | United Kingdom | 402/79 |
| 1131761 | 10/1968 | United Kingdom | 402/501 |

*Primary Examiner*—Mark Rosenbaum
*Assistant Examiner*—S. Thomas Hughes

[57] ABSTRACT

The invention provides for "windowing" leafs of various types which retain their face and perimeter orientation when repositioned with respect to their host binder, including leafs with pluralities of surfaces, leafs with arrays of stacked repositionable notes, leafs and notepads, leafs with arrays of clips, and the like. The invention further provides for the binding of leafs which themselves may be electronic modules, each acting as a means for one of capturing, storing, accessing, displaying, and transmitting information in electronic form. Further, binding system cover is provided which offers a ring binding mechanism that is simple, light weight, and of a closed loop design available in various application specific shapes. Leaves and mounting surfaces according to the invention provide semi-permanent retaining means which enable easy removal and reinsertion, permitting rapid reordering, while retaining their semi-permanent binding during the page turning operation, independent of the weight of the mounting surface, any force orthogonally inward or outward with respect to the host coupling structure, and any position it may take in turning as it twists over its coupling structure, and to book systems formed by combining covers, rings, and mounting surfaces according to this invention that offer compact, reconfigurable, highly visual means for handling heterogenous, mixed media forms of information.

56 Claims, 27 Drawing Sheets

WINDOWING ATTACHMENT FOR A BOOK

CROSS-REFERENCE TO RELATED APPLICATION

This application is a continuation-in-part of commonly assigned U.S. patent application Ser. No. 07/557,157 filed Jul. 20, 1990, now abandoned, which is a continuation in part of commonaly assigned U.S. patent application Ser. No. 07/505,912 filed Apr. 9, 1990, now abandoned.

BACKGROUND OF THE INVENTION

This invention relates to binding systems for the capture, representation, organization, access, presentation, communication, and delivery of information, and to leafs with mounting surfaces which may be directly attached to a host book, its bindings, its surfaces, and or its covers, which in and of themselves provide non-sequential (non-linear) access to their mounting surfaces without needing to be removed from their attachment to the host book, its bindings and/or its surfaces, and which offer further non-linear access when physically removed from their binding and repositioned.

The invention relates to the provision of such non-linear pages which possess the property hereinafter referred to as "windowing", the ability for the page to maintain its face and perimeter orientation in various positions without being removed from the host book to which they are attached, and to such pages implemented with means for semi-permanent attachment, there by offering 2 levels of non-linear access.

The invention further relates to leafs of various types for use on the mounting surfaces according to the invention, including leafs with pluralities of surfaces, leafs with arrays of stacked repositionable notes, leafs with notepads, and to the binding of leafs which themselves may be electronic modules, acting as a means for one of capturing, storing, accessing, displaying, and transmitting information in electronic form.

The invention therefore relates to leaves with mounting surfaces offering semi-permanent retaining means which enable easy removal and reinsertion, permitting rapid reordering for non-linear access, while retaining their semi-permanent binding during the page turning operation, to such mounting surfaces which provide non-linear "windowing" manipulation of their mounting surfaces and which may be permanently attached or semi-permanently attached to the surfaces of the host book and to its binding, and to book systems formed by combining covers, rings, and mounting surfaces according to this invention that offer compact, reconfigurable, highly visual means for handling heterogenous, mixed media forms of information.

The improvement specified according to this invention that permits the movement of surfaces non-linearly with respect to other surfaces of the host book without requiring the removal of the surface from its binding to the book are formed as "windowing flap based mounting surfaces", or HyperFlaps, as they are referred to in the following specification. They may be implemented in such a manner as to be permanently attached to a binding, semi-permanently attached to a binding, and or permanently or semi-permanently attached to any surface, such as a cover, or other surfaces, such as other pages of the host book.

This general feature of non-linear page positioning may be added to or implemented as any one of a number of different surface types designed to improve visual access and dynamic access to a notebook system. Surface types according to this invention offer repositionable indexes, insertable surfaces with arrays of repositionable notes, insertable surfaces with folds of various styles, and surfaces with electronic devices mounted on them.

Computer modules are becoming extremely thin, like a leaf for a book. Additionally, the modules are being designed to provide application specific functions, as smart pages for a host book application. Examples include application specific calculators for word processing, calculating in various accounting activities in such fields as real estate or finance, calorie counting, and the like. Forming a book of application specific calculator pages is feasible. An example application would have each page of an accounting book be an electronic chart of accounts, each page being retained using means according to this invention, each page capable of knowing its position relative to any other page, independent of the ordinal location of the page.

Windowing hyperflap pages that preserve the face and perimeter orientation of the top surface or window and which may be permanently or semi-permanently attached to bindings, binder surfaces, i.e. the cover or other surfaces contained therein, of the host information processing object, (i.e. the blank book or notebook) have been unavailable.

These repositionable mounting surfaces, implemented with removable holes and cut patterns according to this invention, may be implemented with the hole pattern formed as an attachable strip or alternatively implemented directly as part of a surface. These repositionable mounting surfaces are formed with flaps called orientation flaps, that preserve the orientation of the mounting surface in various positions. Such mounting surfaces may comprise a pocket for attaching the information handling media according to the invention, a delivery system for stacks of repositionable notes of varying sizes, indexes with one or more indexing edges, all offered as as easily repositionable pages.

Such windowing pages as described, delivered in a semi-permanent attached fashion, there by offering two levels of non-sequential positioning, have been unavailable to notebook users.

SUMMARY OF THE INVENTION

The invention therefore relates to mounting surfaces that are attached to a flap that preserves the orientation of the face surface of the mounting surface in a plurality of locations, with respect to the book to which it is attached. The binding means for attaching the surface to the book may be permanent, semi-permanent, or require the opening or closing of a ring mechanism for removal and repositioning.

The invention further relates to semi-permanent retaining means which may be implemented via cut hole patterns, flex-lock slot patterns, and attachable tongue "mini-flaps" as extensions of the novel surface, or as adhesive tape mountings, and to strips with said semi-permanent retaining cut hole patterns and flex-lock slot patterns for attaching to mounting surfaces, which enable the easy insertion and removal of said mounting surfaces, while retaining their semi-permanent binding during the page turning operation independent of the outward and inward force placed on the page, orthogonally to the host binding for the page.

The invention further relates to semi-permanent means for retaining loose leafs for operation in high frequency use without suffering the loss of retention due to wear from constant insertion or removal, loops which accept semi-permanently attachable mounting surfaces, and which come in various application specific shapes, and to systems of mounting surfaces, bindings, and covers that when combined offer compact, reconfigurable, highly visual means for handling heterogenous, mixed media forms of information, and to mounting surfaces with special holes that allow the mounting surfaces to be shuffled in any ordinal sequence without opening the retaining binding while remaining permanently retained when turned.

The invention further relates to a design for a semi-permanently attachable mounting surface for the retention of electronic pages formed from application specific electronic modules.

The invention relates to systems used in information handling where highly visual access to said information is desirable and where the continuous recategorization and or updating of that information is likely. Books typically thought to be used purely for delivery of information as reference guides are being increasingly put to use as "active" information tools. This invention relates to applications demanding interactive reuse of manually and visually accessible information, both physical and digital.

An object of this invention is to provide for surfaces which posses non-linear windowing access, i.e. which may be placed in a plurality of locations while preserving the face and perimeter orientation of their "top window surface" while remaining permanently or semi-permanently attached to their host, and which behave as integral "pages" of the information processing object, i.e. the book to which they are attached. The purpose of this aspect of the invention is to offer a variety of surfaces that behave as "windows" for handling information. The objective being to offer rapid, non-linear manipulation, the ability to view more than one surface at a time in a variety of locations, and the ability to preserve the face and perimeter orientation of some of the selected surfaces in a variety of host positions by either selective removal and repositioning or by deterministic folding actions.

Another object of this invention is to offer alternative hole patterns which might be used in conjunction with surfaces according to this invention. Such an alternative hole pattern provided is a "no hole" hole pattern which is a "slotted" pattern that allows for the insertion and deinsertion of any surface implemented with the pattern, by the flexing of the surface for insertion and removal. Such a surface implemented according to the invention will be referred to as having a "flex-lock" binding means. The pattern is an improvement over existing "no hole" style flex entry and removal "slot and post" retainers. The invention provides a means for a 2-slot system that retains its semi-permanent attachment on any ring style binding with 2 or more rings. The slots are formed as hooks along an edge, each hook forming an "opposing C" shape hook. The use of only two hooks allows for rapid flexing in and out of retention and offers significant advantage in use with spiral or multi ring binders(with more than 2 rings per binding) in that the 2 hook design "ignores" all but two(typically the end two) rings avoiding the need for multiple slot aligning and manipulating.

It is the further object of this invention to provide mounting surfaces with the novel hole cut according to the invention, including specially designed leafs as mounting surfaces using the hole or cut pattern design. These leaves would be suitable for applications in which fast visual access along with quick repositioning of leaves in different ordinal positions is required using the repositionable mounting surfaces of orientation flap construction.

A further object of the invention is to provide a simple ring mechanism with a closed loop construction for retaining leaves and mounting surfaces according to the invention.

Additionally, it is an object of this invention to provide a ring enclosure or ring envelop (book) cover means with a top and bottom cover.

Therefore, a final object of the invention is to provide a construction kit for configuring systems comprised of the components according to the invention, said components being capable of being utilized to form a new generation of mixed media, physical object, visual organizing book systems.

In accordance with this invention, two variations of surfaces are implemented as hyperflaps. One hyperflap retains its face and perimeter orientation in four positions about it's host coupling structure while remaining attached to it's host coupling structure. A second hyperflap retains its face and perimeter orientation in two co-planar and substantially adjacent locations about the host coupling structure, while staying attached to the host coupling structure. The first of these two variations is called HyperFlap4 and the second is called HyperFlap2. As will be explained following, HyperFlap4 and HyperFlap2 may be implemented with traditional holes that fix the flap to a binding. It is preferable to implement them with the insertable holes and no-hole patterns according to this invention to improve non-linear access to the information retained on said flaps.

HyperFlap4, has a mounting surface attached to an orientation flap which is in turn attached to an extension flap. The orientation flap is attached to the extension flap via a flexible material which adds heith(clearance height) when the mounting surface is positioned to encompass interleaved sheets which might also be attached to the host binding. The flexible material is optional. So is the retaining means for keeping the mounting surface in a coplanar position, i.e., the cam ridge, retaining strip of velcro, or magnets.

An alternative Hyperflap surface according to this invention that would have the property of operating to either the left or the right outside of the host object, i.e. book or the like, to which it was attached with the capability of having a top window surface that could be placed in adjacent and coplanar locations while preserving the face and perimeter orientations of the surface, while also staying attached to its host at the binding point of the flap to the host is HyperFlapUni2EF. This Hyperflap possesses an extension flap, an orientation flap, and a mounting surface. The main difference in the implementation of the orientation flap and the mounting surface in this case is that they are part of the same surface and are formed as co-rectangular areas connected by a lateral fold. The mounting surface in this case is intended to receive a second mounting surface which would be placed thereon and would carry some form of device such as a pad, a surface with Post-it(tm) notes, an electronic device or the like. Any one of the second surfaces may have a mounting tongue for inserting into a hyperflap mounting surface pocket. This mounting surface may be implemented as a surface with adhesive, a surface receptive to adhesive, or with a pocket for receiving such a tongue. The free edge of the extension flap has a binding for a host object, said binding implemented as a hole pattern, a slot pattern, a mini-flap, an adhesive mini-flap or the like means for binding the surface to a host object such as a book, desk calendar, or the like.

HyperFlap2, has a mounting surface attached to an "orientation flap" along a line substantially parallel to and substantially mid-way between two parallel outer edges of the mounting surface. In this variation the orientation flap has the slotted hole pattern implemented along its parallel edge opposing the edge bound to the mounting surface. This implementation allows for the co-planar location of the mounting surface in two positions about the binding, wherein the face and perimeter orientation of the mounting surface is preserved in both substantially adjacent locations. The orientation flap may be shaped with a "cam ridge" which biases the position of the mounting surface to either one or the other of the two co-planar positions. Alternatively, some form of retaining strip of magnetic material or velcro could be used as a means for retaining the mounting surface in either coplanar position.

An alternative Hyperflap surface that would operate in two positions about its host binding is HyperFlapUni2OF. It is simply a rectangular surface folded in half. One side is a mounting surface and the other is treated as an orientation flap. The orientation flap has a mini-flap or an adhesive strip attached to it for mounting on a host. The mounting surface may have adhesive or be receptive to adhesive or possess a pocket for receiving a tongue from a second mounting surface. Any of the above mentioned mounting surfaces may have stacked arrays of repositionable notes mounted thereon. In one implementation, a rectangular surface is mounted with stacked arrays of repositionable notes. This surface is adhesively attached to the mounting surface of a HyperFlapUniOF type surface, which it itself attached via an adhesive strip to the right side cover of a host desk top information handling device. As in the case of the other HyperFlap modules, this surface may also be formed from a single continuous piece of stock in which the orientation flap is constructed as a contiguous and free extension of a section of the mounting surface which mounting surface is folded back under itself and attached there to. Alternatively, the flap may be constructed with an orientation flap, to which is connected a partial mounting surface. A second surface or media component would be attached thereto. The hyperflap mounting surface may be formed as a pocket in which case a second surface would be attached to it with insertable tongue or the like.

As stated, either of the above mentioned surfaces may be implemented with other patterned holes. In the simplest case, standard holes may be punched for use with open and close multi-ring bindings. In this case, semi-permanent attachment relies on the open-close operation of the binding. A standard cut hole pattern with triangular cavities may be employed, as found in traditional post ring accounting sheets. Any of the HyperFlaps may also be implemented with the curved cut pattern according to the preferred embodiment of the semi-permanent hole pattern according to the invention.

In either the case of the solo orientation flap(Hyperflap2) variation or the combined extension flap/orientation flap version(Hyperflap4), the entire surface may be formed from one piece of material. The hinges which attach the mounting surface to the orientation flap and the orientation flap to the extension flap are intended to act as "living hinges". They can be implemented in plastic, or may be made of molded hinges or any other means for pivotally attaching the surfaces together.

An additional variation of HyperFlap2 and HyperFlap4 has the means of binding to a host surfce provided by an additional "mini-flap". In the case of HyperFlap2, the mini-flap is attached attached directly to the parallel, opposing edge of the orientation flap which is bound to the back of its respective mounting surface. In the case of HyperFlap4, the mini-flap is formed as an additional surface attached to the free edge of the extension flap. In either case, the mini flap may be fixed with an adhesive so that the Hyperflap may be attached to any host surface, or the mini-flap may be made of sufficient length so as to permit the mini-flap of the HyperFlap module to be slid into a pocket, there by providing a simple and flat binding to a host object such as a book with a pocket on a cover, or a page with a pocket on its surface while leaving the extension flap and or the orientation flap free to permit the Hyperflap to operate as intended according to the invention. In any of the above cases the mini-flap can actually be implemented as a folded adhesive strip that attaches to either face of the Hyperflap's binding edge, providing an adhesive means for attaching the Hyperflap to a host surface. The mounting surfaces may be adhesively attached by way of an adhesive strip to their orientation flaps, welded, or hinged in any other way that enables a pivotal attachment.

The HyperFlap modules may be implemented with pockets,sheet sets, calculators, and the like on their surfaces. And, the HyperFlap modules, independent of whether they are semi-permanently bound, mini-flap bound, or adhesively bound, may be folded out of a single piece of stock, where the mounting surface is constructed by folding a section of stock that forms the mounting surface back under itself, binding it to the bottom of the mounting surface at a distance of substantially ½ the breadth of the mounting surface, the orientation flap being formed as the next rectangular extension therefrom. Alternatively, the surface may be formed by constructing an orientation flap with the partial formation of a mounting surface attached there to as a folded rectangular section, the top surface of said partial mounting surface receives a mounting surface or media component such as a pad calculator or the like, which becomes the "window surface". The mounting surface in any of these constructions may be formed as a pocket.

An important variation of the leaf is the variation in which the leaf comprises an additional supra-folded surface. This may be any set of pages, bound in a flat fashion. A preferred embodiment of a flat binding is provided which utilizes a strip of adhesive tape and a set of rectangular sheets, each layered one atop the next, and partially offset from the next so as to allow for the adhesion of each of the edges of the "stair-step edge" thus formed to the tape. By placing the adhesive side of tape along the stair-step edge and allowing a portion of the tape to extend past the stair-step edge, the exposed remainder of adhesive portion of the tape may be folded back and under the stair-step, providing an exceptionally flat hinge for the mounting of the sheets so bound to a host mounting surface. A preferred embodiment of this sheet set would have the sheets made of a clear plastic for the attachment of repositionable notes such as 3M Post-it-Notes ®. This sheet set can be mounted to any of the mounting surfaces according to the invention. In a variation, two such sheet sets are mounted on a host surface which itself is formed by folding a rectangular sheet in half to create two surfaces, with a pocket for receiving a sheet set formed on one of the two surfaces. One of the two surfaces of one sheet set is utilized as a tongue for inserting into the pocket formed on the hyperflap surface. The second surface of said sheet set is used as a mounting surface for other sheet sets. The pocket formed on the hyperflap surface has a slit cut along one edge. The tongue sheet of one of the sheet sets is slipped into the open edge of the pocket, and the outer edge of the top surface or second sheet of this sheet set is slipped into the slit on the pocket, thus retaining the sheet set as a mounting device for other sheet sets, firmly in place. A variation of this has sheets tape bound on the surface of the sheet set mounting device, where the last page of the sheets formed is an "electronic page" where the electronics are selected from any variety of the thin application specific calculators. A preferred embodiment of this variation includes a top sheet comprised of an array of stacks of repositionable notes which may be of varying sizes, adhesively attached.

The ring may be a simple design of any of the known application specific geometric shapes, D-shape, round, oval, slant, and the like said ring being of a closed loop design and thereby not comprising any mechanical device for opening and closing. This makes the ring light, safe from pinching action, and easy and cost effective to manufacture. When the ring possesses an open close binding, the mounting surface may be combined with permanently retained mounting surfaces. The rings may be formed from individual closed loops with stems that are inserted to coupling structures on the cover. The rings may be of the traditional open/close style as well since the surfaces with their semi-permanent means for insertion and deinsertion will work equally well with traditional open/close ring mechanisms. Additionally, it is desirable to implement the flap based surfaces, according to this invention, with not only the semi-permanent insertable patterns but also with traditional punched holes which would also work with traditional open/close ring mechanisms.

The holes according to this invention are formed by a cut pattern that originates out of the "top" of a hole. Further, in accordance with this invention, the alternative "no hole" slot pattern for flex insertion and removal, here-in after referred to as the flex-lock binding or simply flex-lock, of a mounting surface provides a slot pattern that operates efficiently with only 2 slot "hooks" which form opposing "C" shapes, and are positioned in opposite directions and which "hook slide" onto any two rings of the host ring mechanism. The hooks, facing opposite directions, enable the flexible removal of the surface by the simple removal of either hook. The edge with the hooks is flexed approximately at its center to shorten the distance between the hooks sufficiently for one of the hooks to move passed the host ring coupling means. Insertion is a two step process of inserting one hook, and flexing and inserting the other hook. By implementing the hooks along the outer edge of the surface on which they are mounted, only two rings are involved, and there is no interference with any additional rings that may be part of the ring mechanism. The edge of the surface between the hooks rests free of any of the additional rings as does the edge between each respective hook and its associated corner.

The flex-lock binding hooks may be implemented on a flexible strip of material such as plastic, laminated card stock, and the like, which can be adhesively attached or welded to a mounting surface according to the invention.

The hook set can be implemented by any one of a number of patterns. The hooks can be any where along the same edge, and can be along any edge intended for insertion. By allowing positioning anywhere along the edge, the surface may be constructed to extend past the host books pages, thus offering a means for indexing or categorizing the surface.

Alternatively, leaves constructed with holes and patterns according to the invention can be formed as pocketed surfaces, computer modules, and mounting surfaces with extension flaps and pockets attached thereon.

In a variation of a surface with a flap, where the surface is comprised of an extension flap for receiving a second surface, the extension flap may be implemented as a rectangular frame that is hollowed out within, in essence as a "picture frame" without the glass. This would permit written entry of information onto the surface which the extension flap overlayed. Alternatively the extension flap could be made of a clear material which would allow for the visual retrieval of information from the surface on which the extension flap was overlayed.

The top, side, and bottom edges of the mounting surface can be used for indexing.

Rings according to the invention may be of the traditional open/close style but preferably will be simple closed loop designs formed from plastic or some other light, rigid material.

The covers can be implemented with a closed loop ring mounted on a "bottom card" or a slim line open/-close ring on a bottom card fashioned in such a way that the card and ring sets stack as "notebook shelves".

Combined as a system, the hyperflap surfaces with their special array of holes,open-cover design, and closed loop rings offer a light, low cost means for building visually accessible information handling book applications. An application of particular value is that of a visual organizing system, wherein the mounting surfaces are oversized clear acetate pockets with flaps for the retaining of heterogenous forms of physical objects, typically including folders and loose leafs of various sizes and shapes. The pockets are fitted with the special purpose array of holes according to the invention and the cover itself is formed from clear poly material, offering complete see through advantage, even when closed. The invention relates to a special purpose cover and ring mechanism for retaining mounting surfaces with holes so constructed according to this invention.

The combination of all three components results in the construction of a book cover and binding system with repositionable leaves according to the invention that offers a highly open and visual access system for the manipulation of heterogenous forms of information.

BRIEF DESCRIPTION OF THE DRAWINGS

The above and other objects and advantages of the invention will be apparent from consideration of the following detailed description, taken to conjunction with the accompanying drawings, in which like reference characters refer to like parts throughout and in which:

FIG. 1*a* shows a top view of a HyperFlap formed from an extension flap, an orientation flap, and a mounting surface where the extension flap is formed with multiple closed holes punched along the outer, lengthwise edge of the extension flap.

FIG. 1*b* shows a side view of FIG. 1*a*.

FIG. 1*c* shows a side view of the fold pattern for making the flap and mounting surface from a single piece of stock where a surface is folded back under the mounting surface and adhesively attached there to, with the orientation flap extending as a free surface there from.

FIG. 1*d* shows a side view of FIG. 1*c* in which the adhesive binding between the mounting surface and the folded back and under surface are flat.

FIG. 1*e* shows a side view of the construction of an orientation flap and partial mounting surface, where a full mounting surface is adhesively to be attached to the partial mounting surface.

FIG. 1*f* shows the surface of FIG. 1*e* in which the mounting surface is adhesively attached to the partial mounting surface.

FIG. 10 shows a HyperFlap2 with a pocket formed on its mounting surface. The pocket has two openings on either side for receiving a tongue and a slit for receiving a tongue.

FIG. 11 shows a HyperFlap with a hole set formed according to the preferred embodiment of the patterned hole according to the invention.

FIG. 12*a* shows a top view of a HyperFlap where the module is formed from a mounting surface and an orientation flap and where the outer edge of the orientation flap is formed with multiple closed holes for attaching to a ring binder.

FIG. 12*b* shows a side view of FIG. 12*a*.

FIG. 12*c* shows a side view of the fold pattern for making the flap and mounting surface from a single piece of stock where a surface is folded back under the mounting surface and adhesively attached there to, with the orientation flap extending as a free surface there from.

FIG. 12*d* shows a side view of FIG. 12*c* in which the adhesive binding between the mounting surface and the folded back and under surface are flat.

FIG. 12*e* shows a side view of the construction of an orientation flap and partial mounting surface, where a full mounting surface is adhesively to be attached to the partial mounting surface.

FIG. 12*f* shows the surface of FIG. 12*e* in which the mounting surface is adhesively attached to the partial mounting surface.

FIG. 14*d*1 shows the HyperFlap of FIG. 14*d* in which a page set bound along one edge and possessing a tongue page is insertable, following the dotted lines, into the pocket on the mounting surface of the HyperFlap of FIG. 14*d*.

FIG. 14*e* shows the HyperFlap of FIG. 14*d* with the page set of FIG. 14*d*1 inserted, where the HyperFlap is positioned out and to the right of the host surface to which it is attached, shown as a cut away surface.

FIG. 16*n* shows a slot aperture of key hole shape in which the aperture is a channel offset above and connected to a hole.

DETAILED DESCRIPTION OF THE INVENTION

Figures 1A, 1B, 1C, 1D, 1E, 1F:
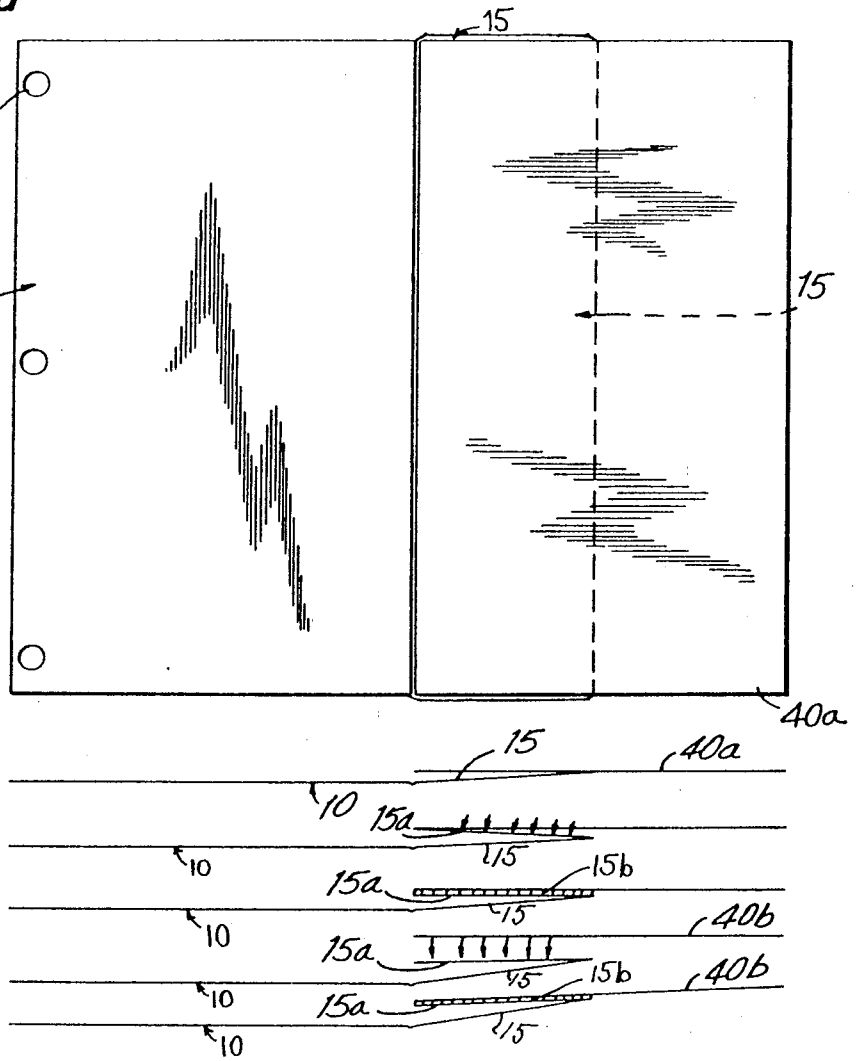

FIGS. 1*a* and 1*b* show a preferred embodiment of a four position HyperFlap, where the HyperFlap module further comprises a series of multi-punched holes of closed hole form, 51*a*, along an edge of the extension flap, surface 10. FIG. 1*b* is a cross section of 1*a* in which the orientation flap, 15 is shown directly connected to the mounting surface, 40*a*.

FIG. 1*c* shows an alternative means for constructing the surface of FIG. 1*b*, in which the mounting surface is folded back under itself, forming a surface 15*a*, which is attached there under, and flat formed, as shown in FIG. 1*d*, where the adhesive means for connecting the surfaces, 15*b*, is shown sandwiched between 15*a* and the mounting surface 40*a*.

FIG. 1*e* shows an alternative means for constructing the surface of FIG. 1*b* in which the mounting surface is formed as a partial surface 15*a*, to which is attached a free second surface, as a window surface, 40*b*. FIG. 1*f* shows these tow surfaces flat and adhesively bound by adhesive 15*b*, sandwiched between partial mounting surface 15*a* and secondary mounting surface 40*b*. Of course, the construction of FIGS. 1*a*–*f* could be formed with a HyperFlap with any of the styles of semi-permanent binding edges according to this invention.

Figure 2A:
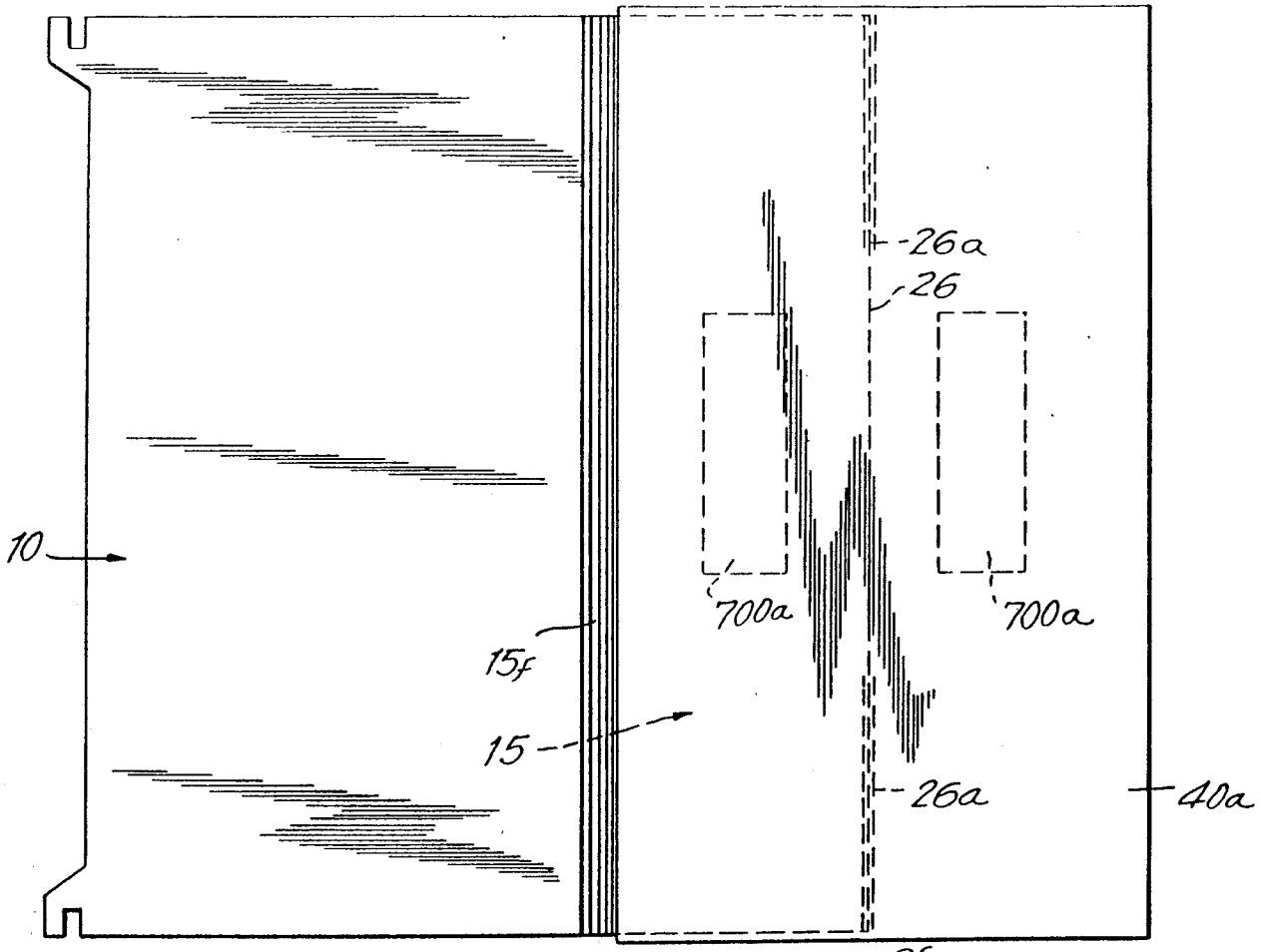
FIG. 2*a* shows a top view of an extension flap, an orientation flap, and a mounting surface in which the hook set for semipermanent attachment is formed on one edge of the extension flap. Semi-permanent retention is implemented with retaining means shown here as magnetic strips.

FIG. 2*a* shows an extension flap, 10, a flexible hinge 15*f*, for attaching an orientation flap 15 to the extension flap 10, and a mounting surface 40*a* hinged along line 26 via hinge 26*a* to extension flap 15.

Figure 2B:
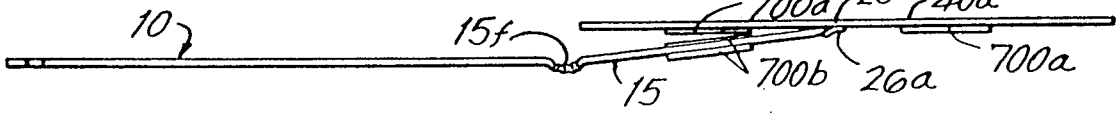
FIG. 2*b* shows a side view of FIG. 2*a*.

FIG. 2*b* shows is a across section of FIG. 2*b* with retaining strips 700*a* implemented as metal and 700*b* as magnetic material.

Figures 3A, 3B, 3C, 3D:
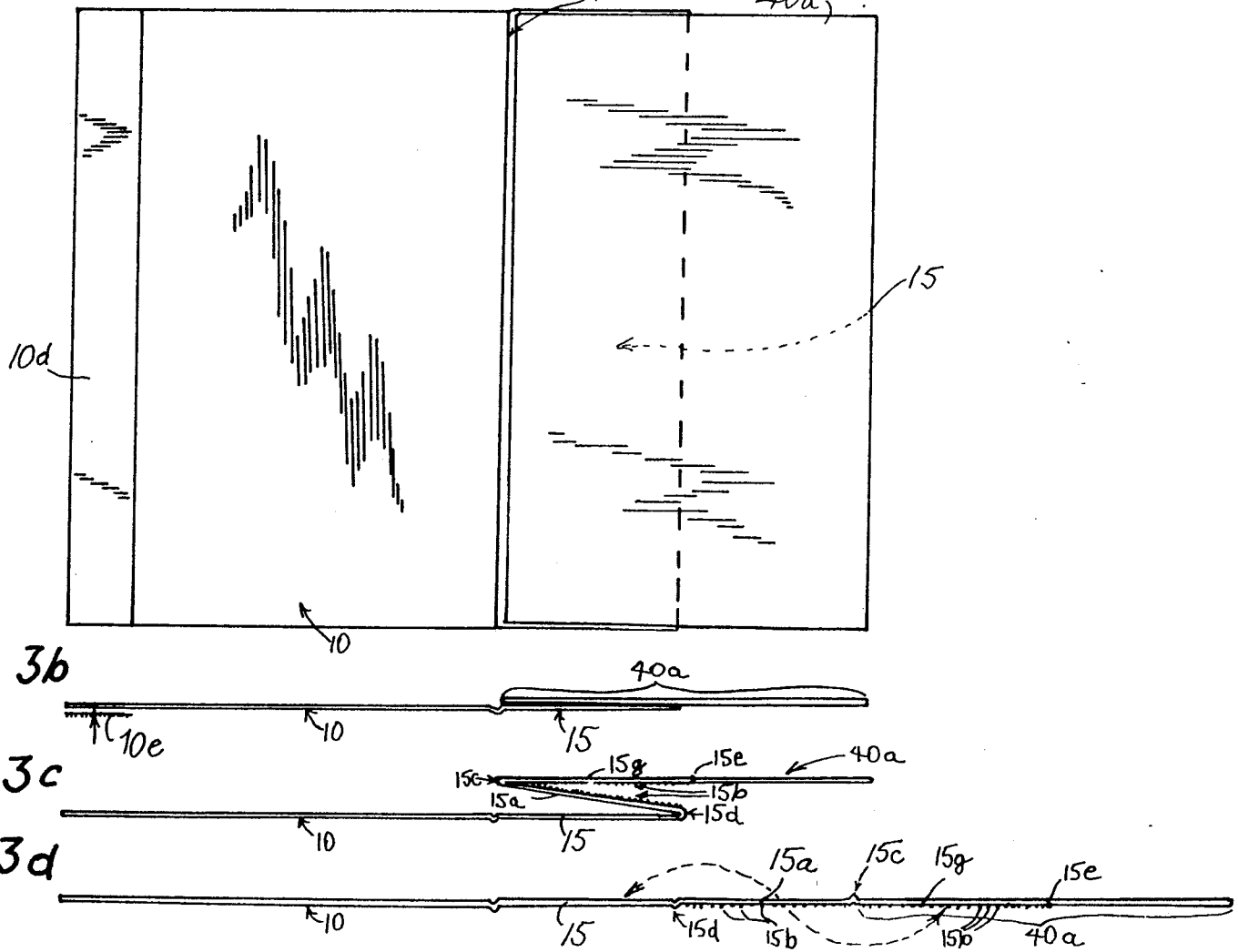
FIG. 3*a* shows the planar top view of the HyperFlap of FIG. 29.
FIG. 3*b* shows a side view of FIG. 3*a* further showing an adhesive tape which may be placed on a surface of the mini-flap.
FIG. 3*c* shows a side view of the surface of FIG. 3*a* implemented from a single sheet of material, where the sheet of material is folded back over itself and glued or otherwise joined, to form the extension flap.
FIG. 3*d* shows the side view of the surface of FIG. 3*c* in fully distended or unjoined position with an arrow indicating where the surface would be folded back over itself to form the extension flap.

FIGS. 3 *a, b, c,* and *d* show the four position HyperFlap in corresponding views. FIG. 3*a* is a top view. FIG. 3*b* is a side view of FIG. 3*a*, where an adhesive 10*e*, is shown. The adhesive may be placed on either surface of mini-flap 10*d*. FIG. 3*c* shows a side view of a version of the four position HyperFlap, where the construction of the orientation flap is detailed. In this variation, the entire surface is made from one continuous piece of material. Orientation flap 15 is formed by folding back over itself to form a double surface, the edge of which is shown in this view, 15*a*. The surface is adhesively joined so as not to separate when in motion. FIG. 3*d* is the side view of the extended continuous surface of FIG. 3*c*. Surface 15*a* is depicted as the edge between the two crease points 15*c* and 15*d*, and edge 15*f* is the edge between crease points 15*c* and 15*e*. An adhesive is applied along the surface between crease points 15*e* and 15*d*, said adhesive shown as 15*b*. To form the orientation flap, the material is folded at crease points 15*d* and 15*e* and the adhesive functions to join the surfaces represented by edges 15*a* and 15*g*. The orientation flap 15, is then free to move according to the invention.

Figure 4:
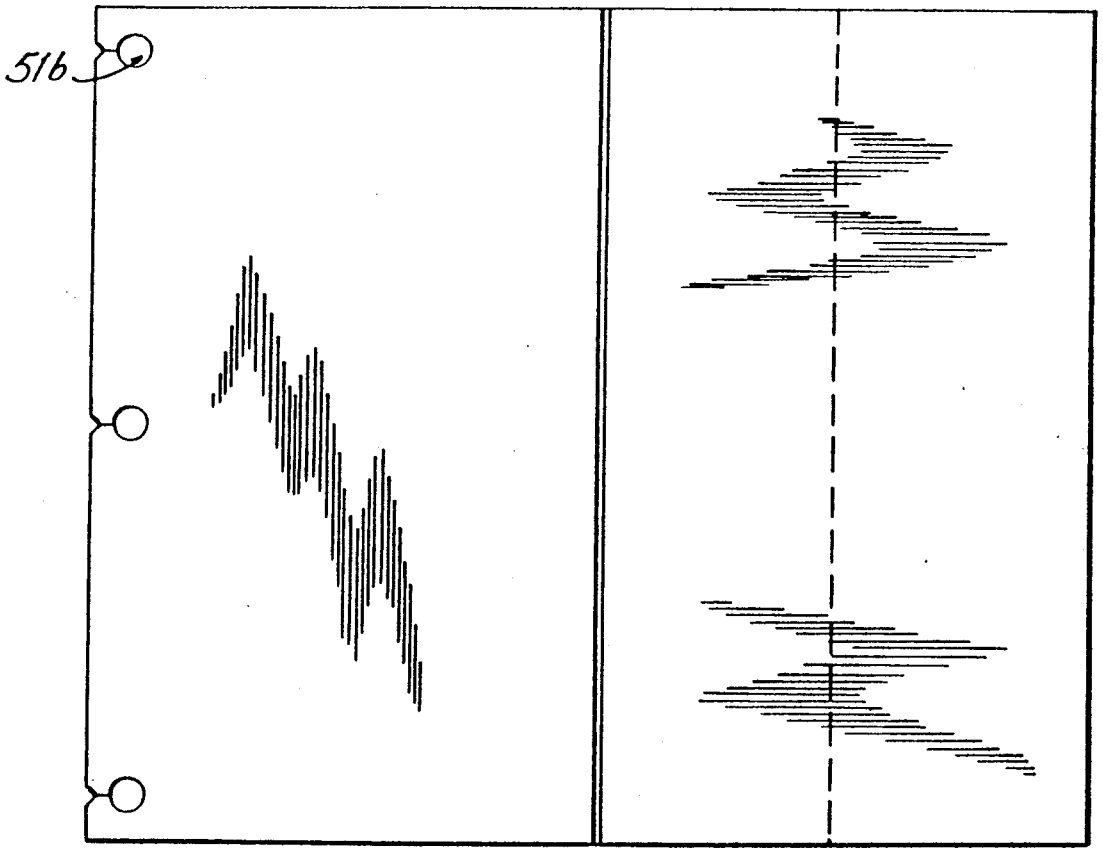
FIG. 4 shows the Hyperflap of FIG. 1*a* with a hole set formed with a cut pattern comprised of triangular wedges and a slit.

FIG. 4 shows the HyperFlap of FIG. 3*a* with an alternative cut pattern hole, 51*b*.

Figure 5:
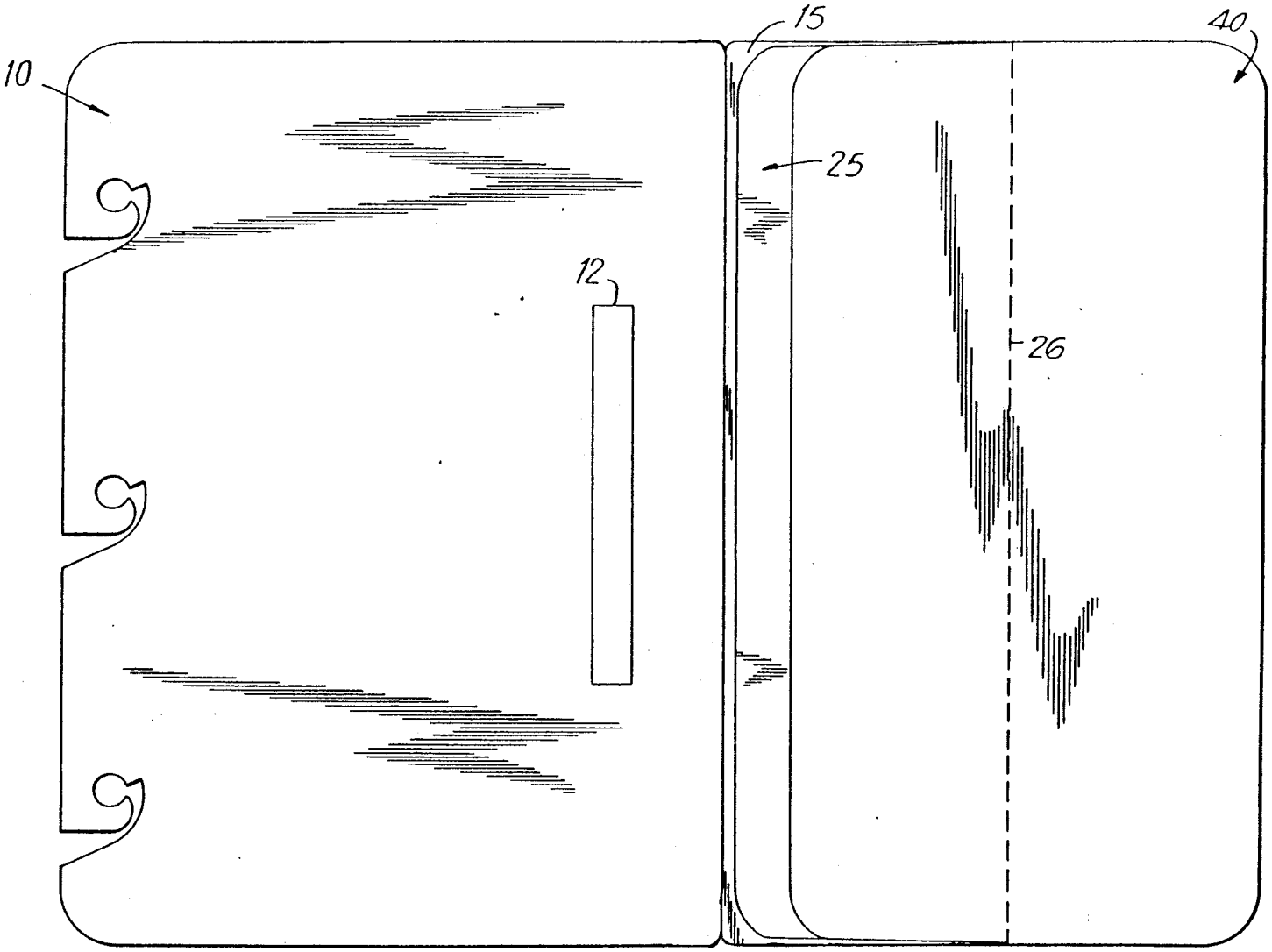
FIG. 5 shows a surface mounted with an extension flap, and pocketed mounting surface, the surface having holes shaped according to the invention.

FIG. 5 shows a mounting surface 10 with and extension flap 15, hinged along the back of surface 40 at line 26. Surface 40 has a pocket 25. Additionally, mounting surface 40 has means for semi-permanently retaining the leaf 40 in each of its positions about the extension flap as well as in its position when "closed" and resting in a co-planar position over surface 10. Retaining strip 12 is located on surface 10 to facilitate this retention.

Figure 6B:
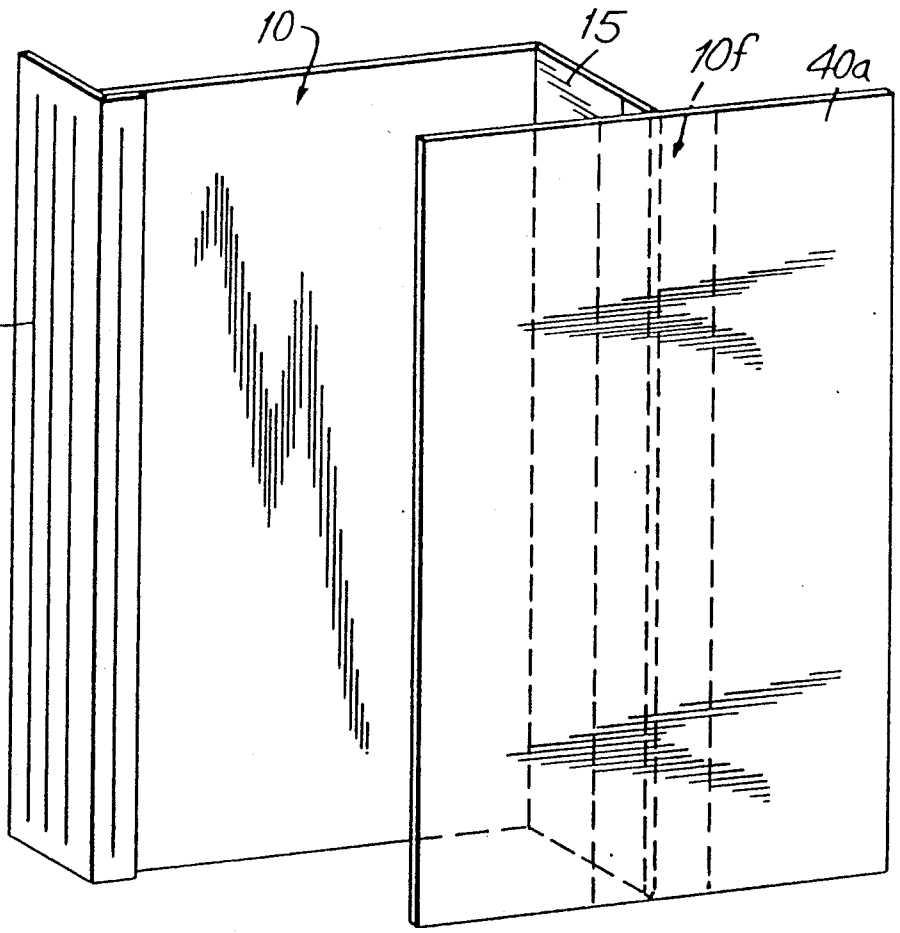
FIG. 6*b* shows a front perspective of a HyperFlap comprised of an extension flap and orientation flap, with an additional mini-flap formed along the outer edge of the extension flap by an adhesive strip, for attaching the HyperFlap to a host object such as a book cover, book page, or the like. The mounting surface is adhesively attached to the orientation flap via a hinged material.
Figure 6A:
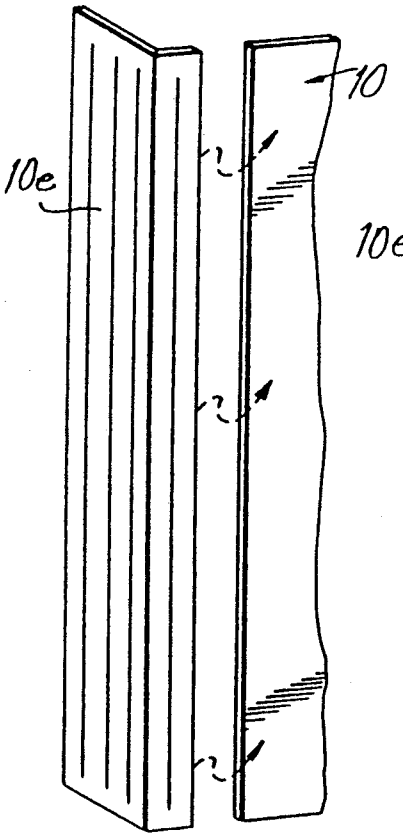
FIG. 6*a* shows an adhesive strip for attaching to an extension flap

FIG. 6*a* shows a binding strip, 10*e*, which may be folded and attached to a cut away portion of an extension flap 10. Binding strip 10*e* may have adhesive on either surface.

FIG. 6*b* shows a HyperFlap4 module with a mounting surface 40*a* attached by an adhesive strip 10*f* to an extension flap 15, which is in turn formed with an extension flap 10, to which the adhesive mini-flap, 10*e*, is attached.

Figure 6C:
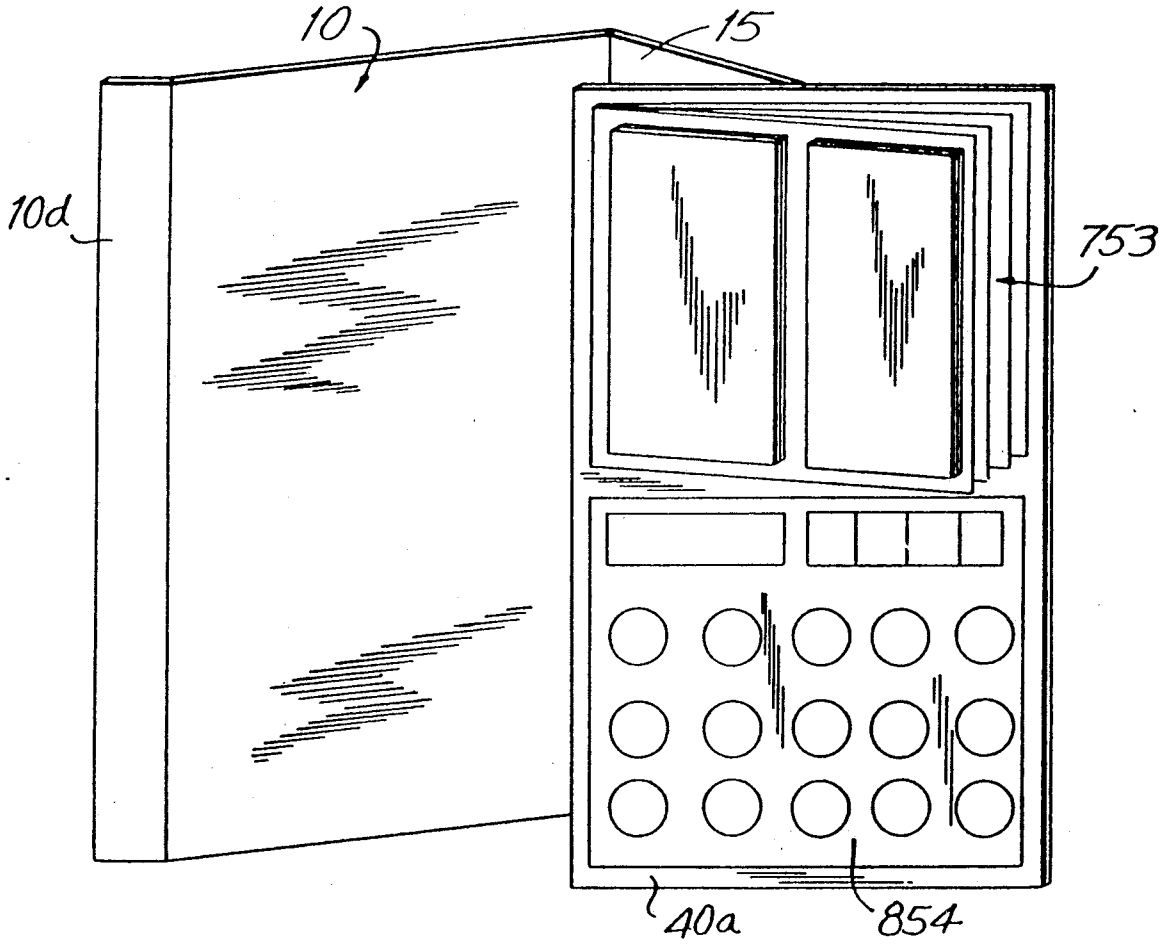
FIG. 6*c* shows a HyperFlap4 with a surface on which is directly mounted a sheet set with stacked arrays of repositionable and an electronic module.

FIG. 6*c* shows a four position HyperFlap module with a mounting surface, 40*a* having a sheet set, 753, and an electronic module, 854, mounted directly thereon. Orientation flap 15, is connected to surface 10 which acts as an extension flap. The HyperFlap has an additional rectangular section, a "mini-flap", 10*d*, connected lengthwise to extension flap, 10. The mini-flap can be of arbitrary width and may have an adhesive applied to it. The mini-flap serves to permit the binding of the HyperFlap to a host surface without impacting the behavior of the extension flap in combination with the orientation flap.

Figure 7A:
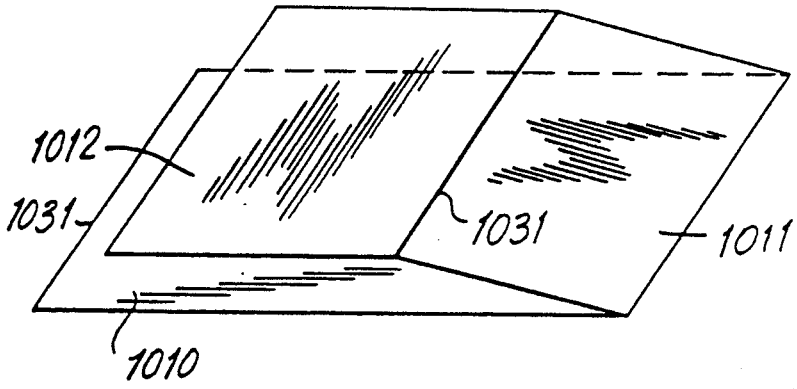
FIG. 7*a* shows a HyperFlapUni2EF surface comprised of an extension flap and a second folded surface forming a combined mounting flap and orientation flap.
Figure 7B:
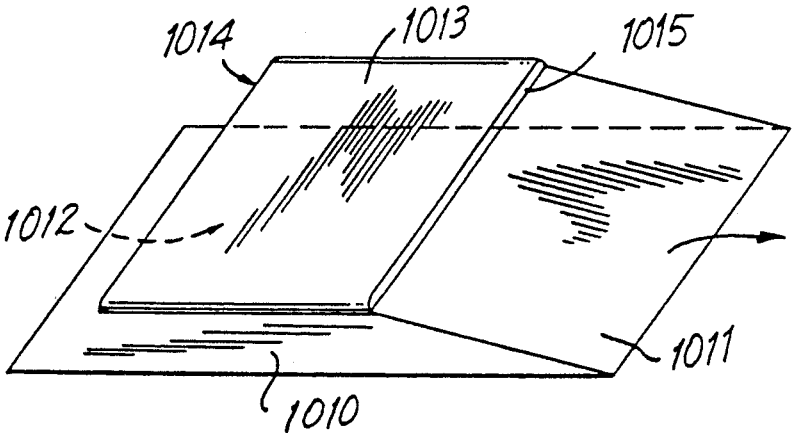
FIG. 7*b* shows the surface of 7*a* where the mounting surface is formed with a pocket.
Figure 7C:
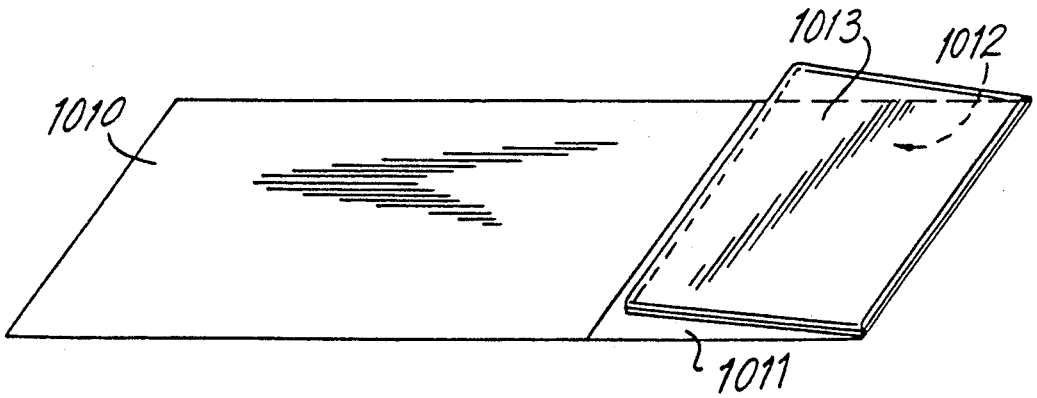
FIG. 7*c* shows the surface of 7*b* extended to the right by folding the mounting surface over the orientation flap.
Figures 7D, 7E, 7F, 7G:
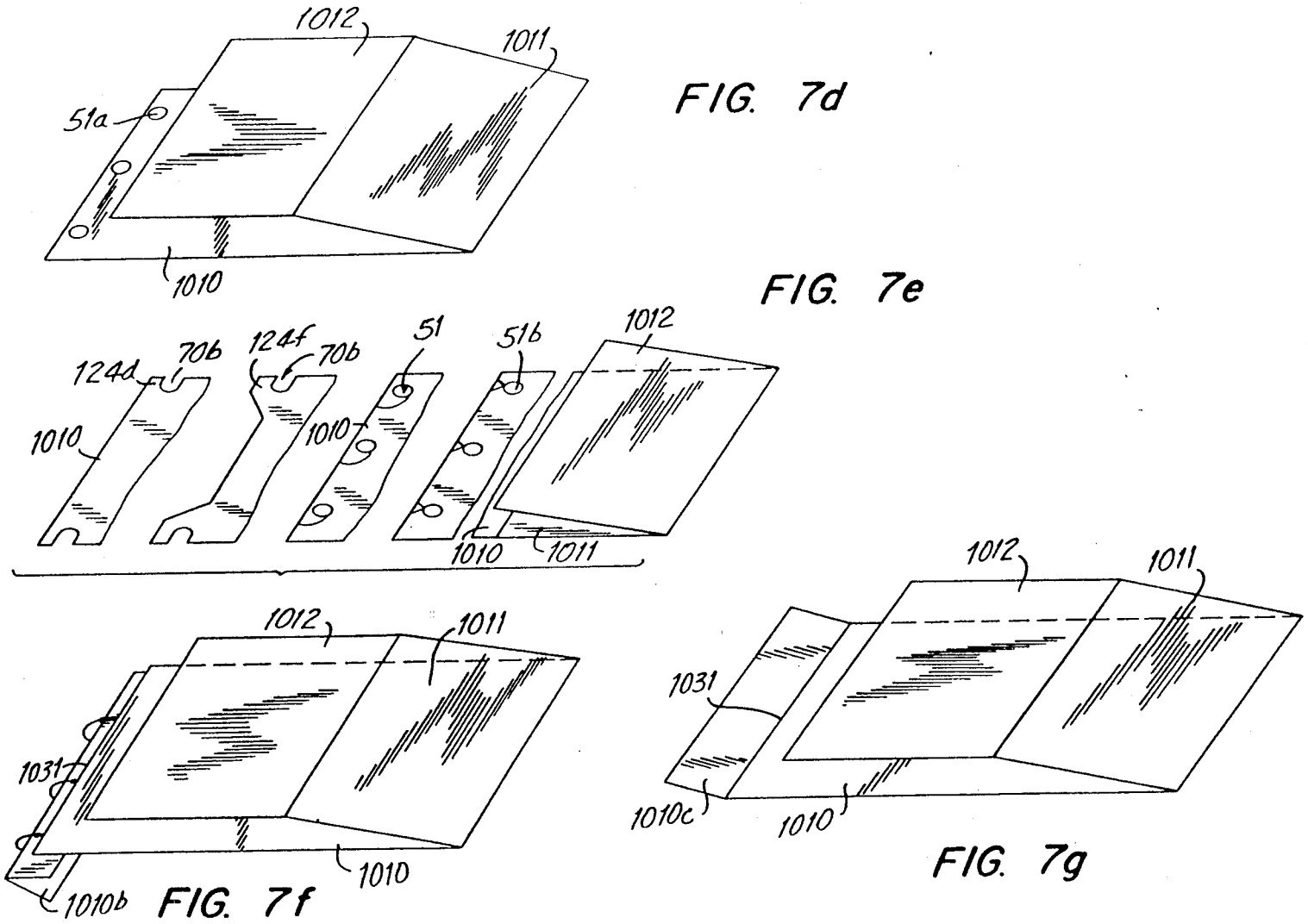
FIG. 7*d* shows the HyperFlap of FIG. 7*a* where the extension flap has a hole pattern cut on its free binding edge.
FIG. 7*e* shows the HyperFlap of FIG. 7*a* where in the extension flap binding has one of a variety of cut hole patterns and slot patterns on its free binding edge.
FIG. 7*f* shows the HyperFlap of FIG. 7*a* with a mini-flap formed from a piece of adhesive striping.
FIG. 7*g* shows the HyperFlap of FIG. 7*a* with a mini-flap formed as a contiguous rectangular part of the extension flap.

FIG. 7*a* shows a HyperFlapUni2EF surface comprised of an extension flap, 1010, and a second folded surface forming a combined mounting flap, 1012 and orientation flap, 1011. This surface would have the property of operating on either the left side or the right side of the host object, i.e. book or the like, to which it was attached with the capability of having a top window surface attached to the mounting surface 1012, that could be placed in one of two adjacent and coplanar locations while preserving the face and perimeter orientations of the surface, while also staying attached to its host at the binding point of the flap to the host. HyperFlapUni2EF possesses an extension flap, an orientation flap, and a mounting surface. The main difference in the implementation of the orientation flap and the mounting surface in this case is that they are part of the same surface and are formed as co-rectangular areas connected by a lateral fold, 1030. The mounting surface in this case is intended to receive a second mounting surface which would be placed thereon and would carry some form of device such as a pad, a surface with Post-it( TM ) notes, an electronic device or the like. Any one of these secondary surfaces may have a mounting tongue for inserting into a pocket. The mounting surface, 1012, may be implemented as a surface with adhesive, a surface receptive to adhesive, or with a pocket for receiving such a tongue, as shown in FIG. *7b*. FIG. *7b* shows the surface of *7a* where the mounting surface is formed with a pocket, 1013, possessing two openings, 1014 and 1015. The free edge of the extension flap, 1031, is for binding to a host surface. FIG. *7c* shows the surface of *7b* extended to the right by folding the mounting surface, 1012, with it's pocket 1013, over the orientation flap, 1011.

In FIGS. *7d* and *e*, the free edge of the extension flap, 1031, of the HyperFlap of FIG. *7a* is shown having a binding for a host object, said binding implemented as a hole pattern, a slot pattern, a mini-flap, an adhesive mini-flap or the like means for binding the surface to a host object such as a book, desk calendar, or the like. FIG. *7d* shows the HyperFlap of FIG. *7a* where the extension flap has a hole pattern cut on its free binding edge, of shape 51*a*. FIG. *7e* shows the HyperFlap of FIG. *7a* where in the extension flap binding has one of a variety of cut hole patterns and slot patterns on its free binding edge 124*d*/70*b*, 124*f*,70*b*, 51, and 51*b*. FIG. *7f* shows the HyperFlap of FIG. *7a* with a mini-flap formed from a piece of adhesive striping,1010*b*, which attaches to the free edge of the extension flap, 1031. FIG. *7g* shows the HyperFlap of FIG. *7f* in which the mini-flap, 1010*c*, and extension flap, 1010, are formed by a pivotal fold, 1031, in a single continuous piece of material.

Figure 8:
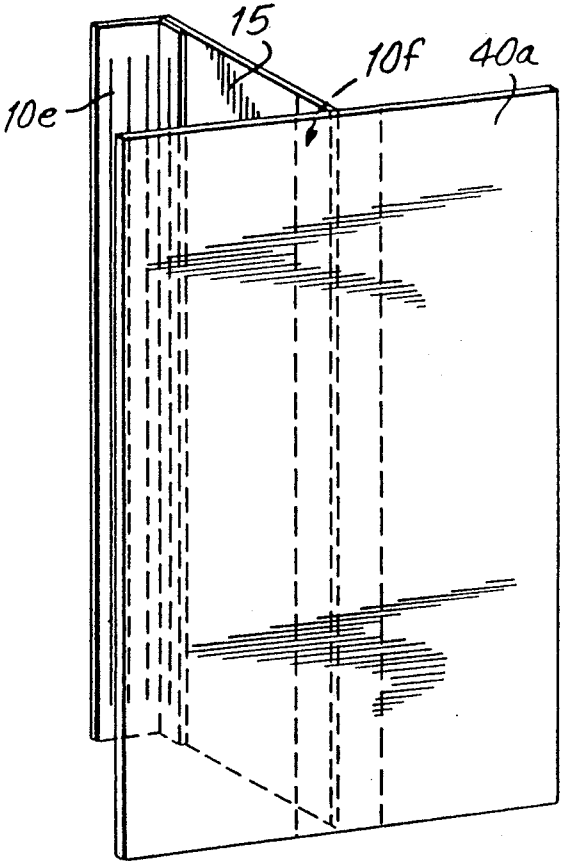
FIG. 8 shows a front perspective of a HyperFlap comprised of an orientation flap with an additional mini-flap formed by an adhesive strip of material along the outer edge of the orientation flap, for attaching the HyperFlap to a book cover, book page, or the like. The mounting surface is adhesively attached to the orientation flap via a hinged material.

FIG. 8 shows a 2 position HyperFlap in which mounting surface 40*a* is adhesively attached to extension flap 15 via tape strip 10*f*. The mini-flap, 10*e*, is provided by an adhesive strip which offers a universal means for attaching the flap to any object.

Figure 9:
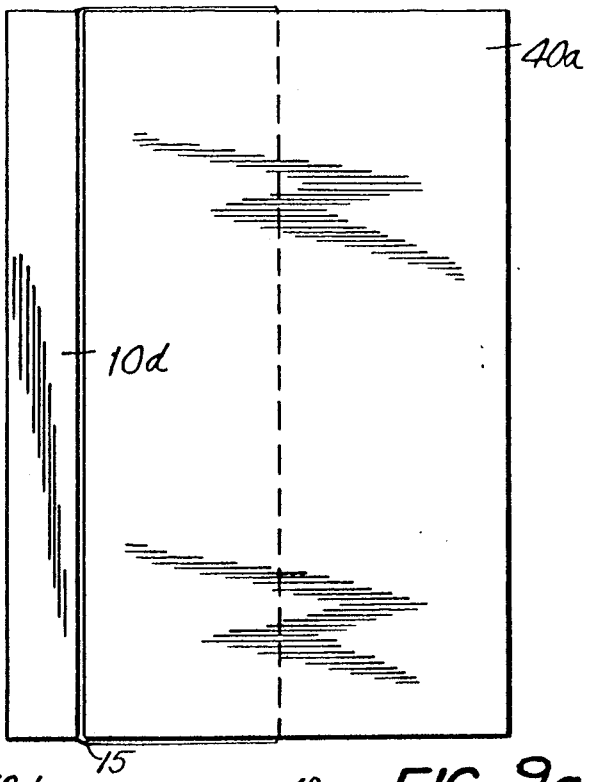
FIG. 9 shows a planar top view of the HyperFlap of FIG. 30.
Figure 9A:
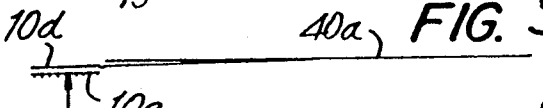
FIG. 9*a* shows a side view of the HyperFlap of FIG. 32, further showing an adhesive tape which may be placed on a surface of the mini-flap.
Figure 9B:
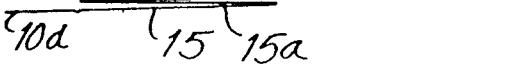
FIG. 9*b* shows a side view of the HyperFlap of FIG. 32 where the surface is formed from a single piece of material, and the extension flap is formed by folding the material back over itself and adhesively joining the folded over section.

In FIG. 9, a top view of the dual position hyperflap of FIG. 8 is shown. FIGS. 9*a* and 9*b* show similar constructions to FIGS. 3*b* and 3*c* where the only difference is that the HyperFlap is a dual position module. FIG. 9*b* shows the same continuous sheet construction a s 3*c* where the orientation flap is formed by adhesively joining surface 15*a* to surface 40*a*.

Figures 10, 11, 12A, 12B, 12C, 12D, 12E, 12F:
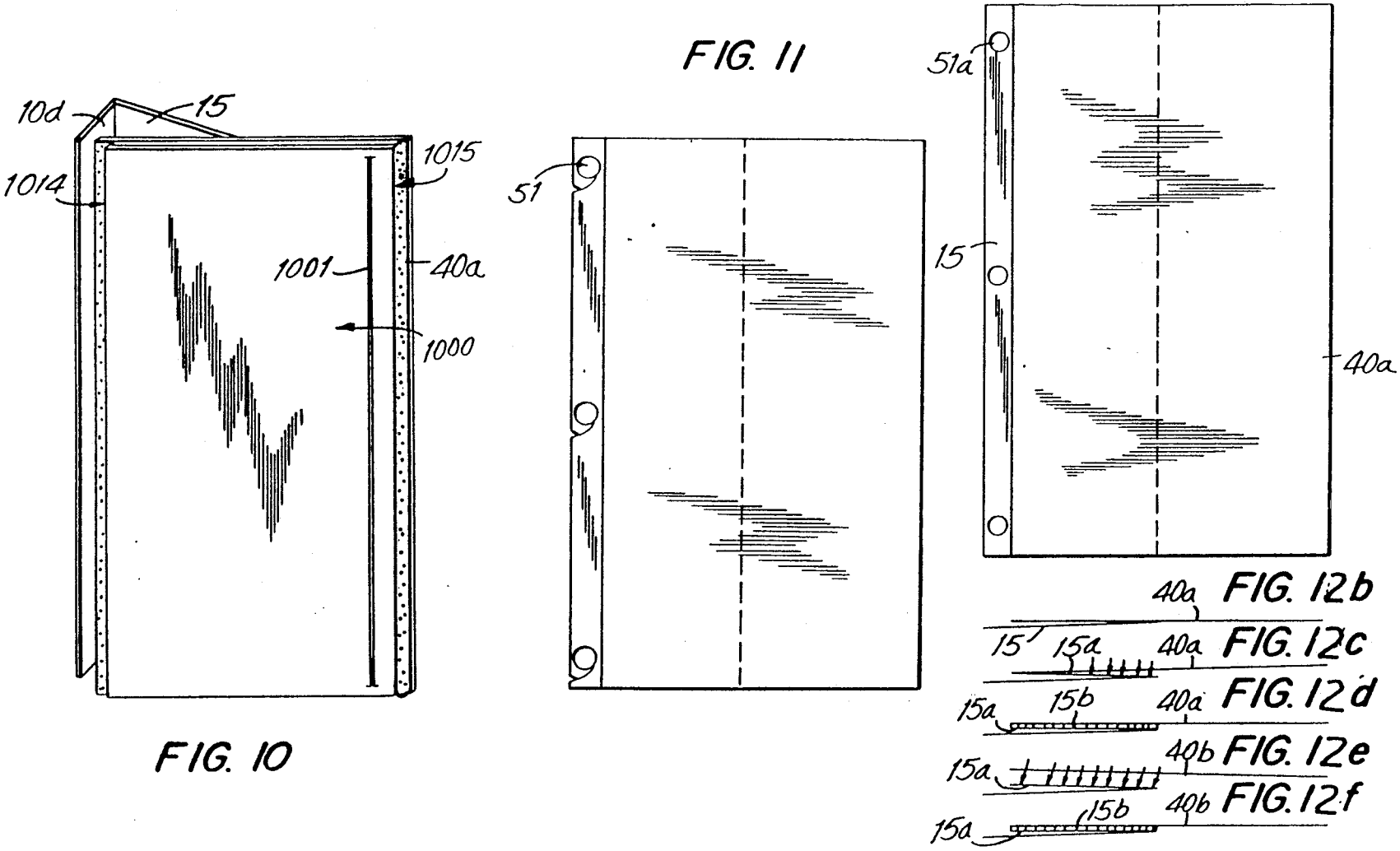

In FIG. 10, a two position HyperFlap module is shown where surface 40*a* has an envelop pocket 1000 on its surface with a lateral slit, 1001, and two openings 1014 and 1015, for receiving a tongue from a second mounting surface. Orientation flap 15 is augmented with "mini-flap" 10 as in FIG. 6. The mini-flap may have an adhesive attached to it or it may be used as a "tongue" to insert into a flap. The mini-flap permits the unhampered operation of the orientation flap when the mini-flap is bound to a host surface.

FIG. 11, shows a dual position HyperFlap, with a cut pattern hole 51 according to one of the preferred embodiments of the invention.

FIG. 12*a* shows a dual position HyperFlap with closed holes, 51*a*, along one edge of the orientation flap, 15.

FIG. 12*b* is a side view of FIG. 12*a*, with orientation flap 15, shown in side view.

FIG. 12*c* shows an alternative means for constructing the surface of FIG. 12*b*, where the mounting surface is folded back under itself forming surface 15*a*, which is adhesively attached to the mounting surface. The orientation flap, extending therefrom.

FIG. 12*d* shows the construction of FIG. 12*c* in which the adhesive binding of surface 15*a* to mounting surface 40*a* is flat and secure, with adhesive 15*b* sandwiched between.

FIG. 12*e* shows an alternative means for constructing the surface of FIG. 12*b*, in which a partial mounting surface, 15*a*, is formed contiguously with the orientation flap, 15, to which is to be attached a second mounting surface 40*b*.

FIG. 12*f* shows the construction of FIG. 12*e* in which the surface secondary mounting surface, 40*b*, if flat and adhesively attached to the partial mounting surface 15*a*, with adhesive 15*b* sandwiched between.

Figures 13A, 13B:
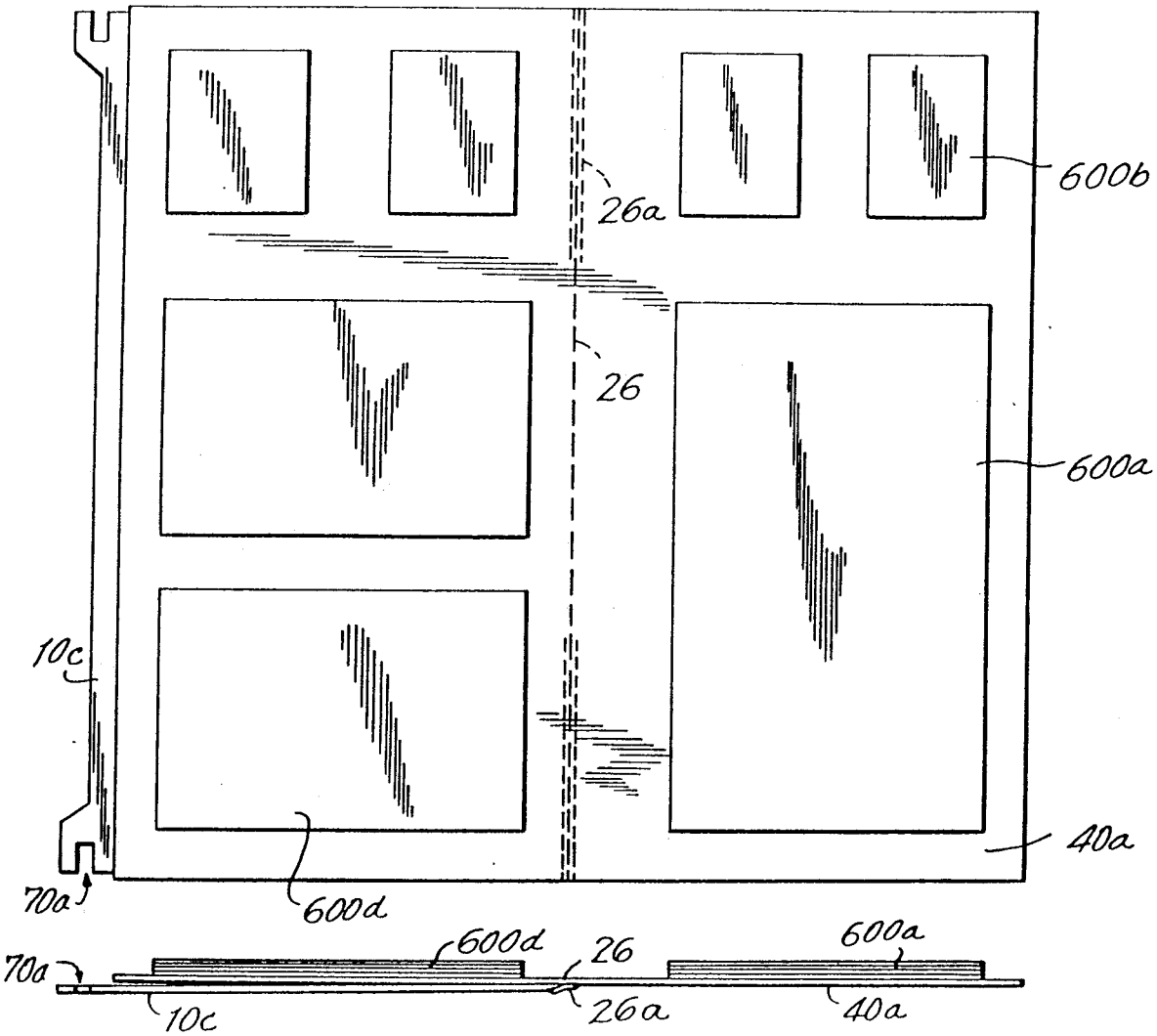
FIG. 13*a* shows a top view of an orientation flap having a hook set on one edge attached to the "middle" of a mounting surface on the other edge with the orientation flap and mounting surface in one of two co-planar positions.
FIG. 13*b* shows the side view of FIG. 13*a*.

FIG. 13*a* shows an orientation flap, 10*c*, which has hooks implemented on one end and a mounting surface 40*a* attached on the other. The mounting surface is hinged along line 26 which is substantially in the middle of the mounting surface and is retained by a hinge means 26*a*. The mounting surface has an array of stacks of repositionable notes 600*a,b,d* arranged on its surface.

FIG. 13*b* shows a side view of FIG. 13*a*.

Figure 13D:
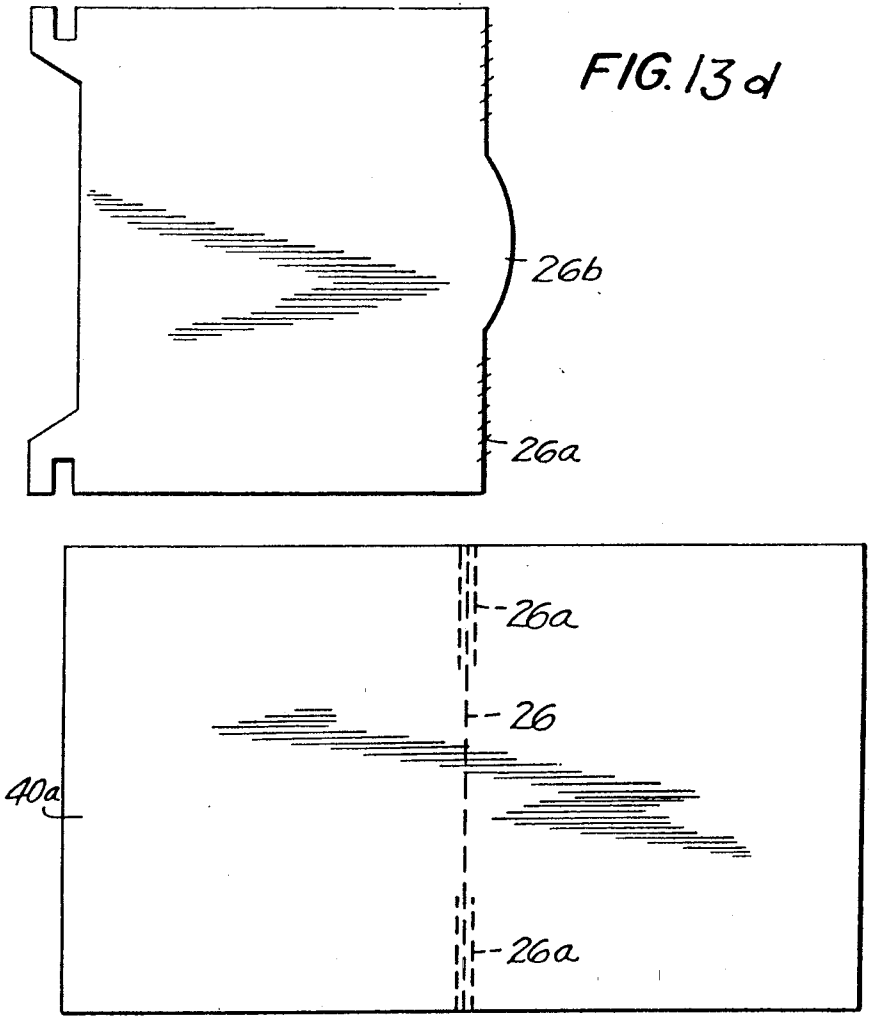
FIG. 13*d* shows how the orientation flap can be implemented with a "cam ridge" for mechanically retaining the mounting surface in either coplanar position.
Figure 13C:
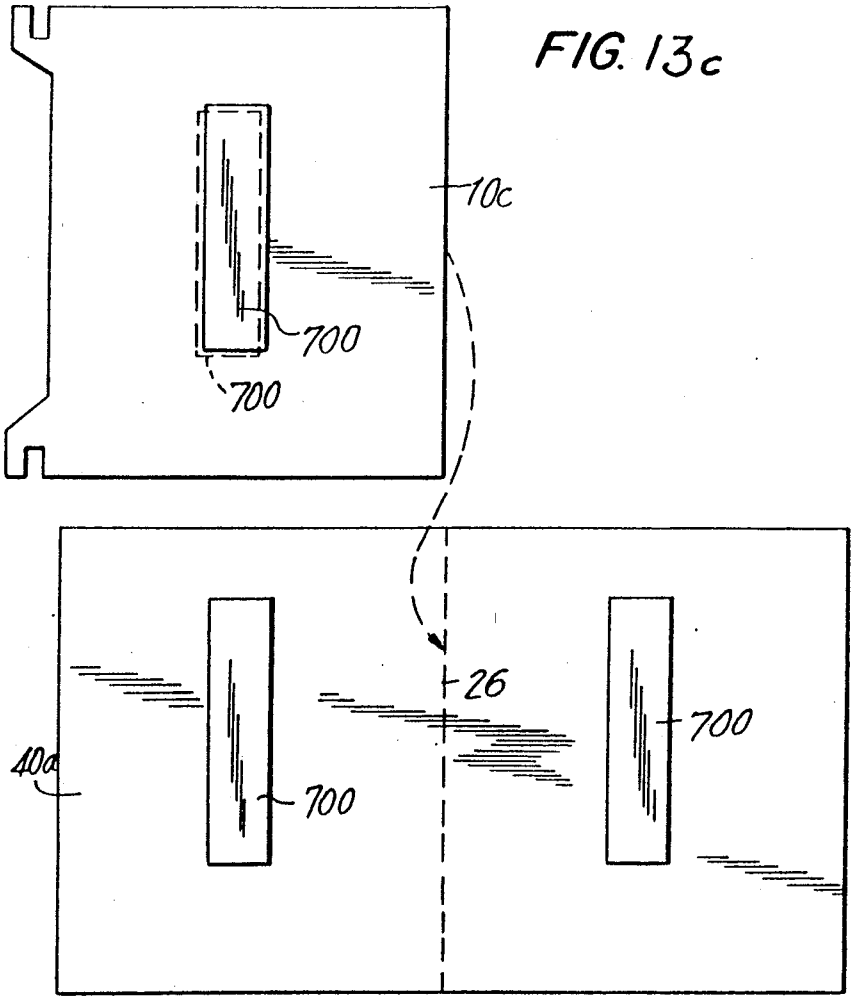
FIG. 13*c* shows the two respective parts of 13*a* as an explosion also showing retaining means for keeping flap in a coplanar position.

FIG. 13*c* shows an explosion of FIG. 13*b* viewed from the bottom with retaining strips 700 in plain view.

FIG. 13*d* shows an orientation flap implemented with a "cam ridge" 26*b*. The cam ridge operates as a "mechanical switch" which biases the folding operation of the mounting surface into a coplanar position. The hinge 26*a* ends before the cam ridge and the cam ridge is free to turn from side to side against the mounting surface. The cam ridge presses against the mounting surface as the mounting surface is reoriented and folded. The mounting surface and/or cam ridge can each "give" or flex as the cam passes the mid point 26, and switches to the other side. The mid point 26 can be implemented with a small ridge to produce a clicking sound on the passing of the cam. When coplanar, the protruding edge of the cam encourages the surfaces to lie flat, in a coplanar position.

Figures 14A, 14B, 14C, 14D:
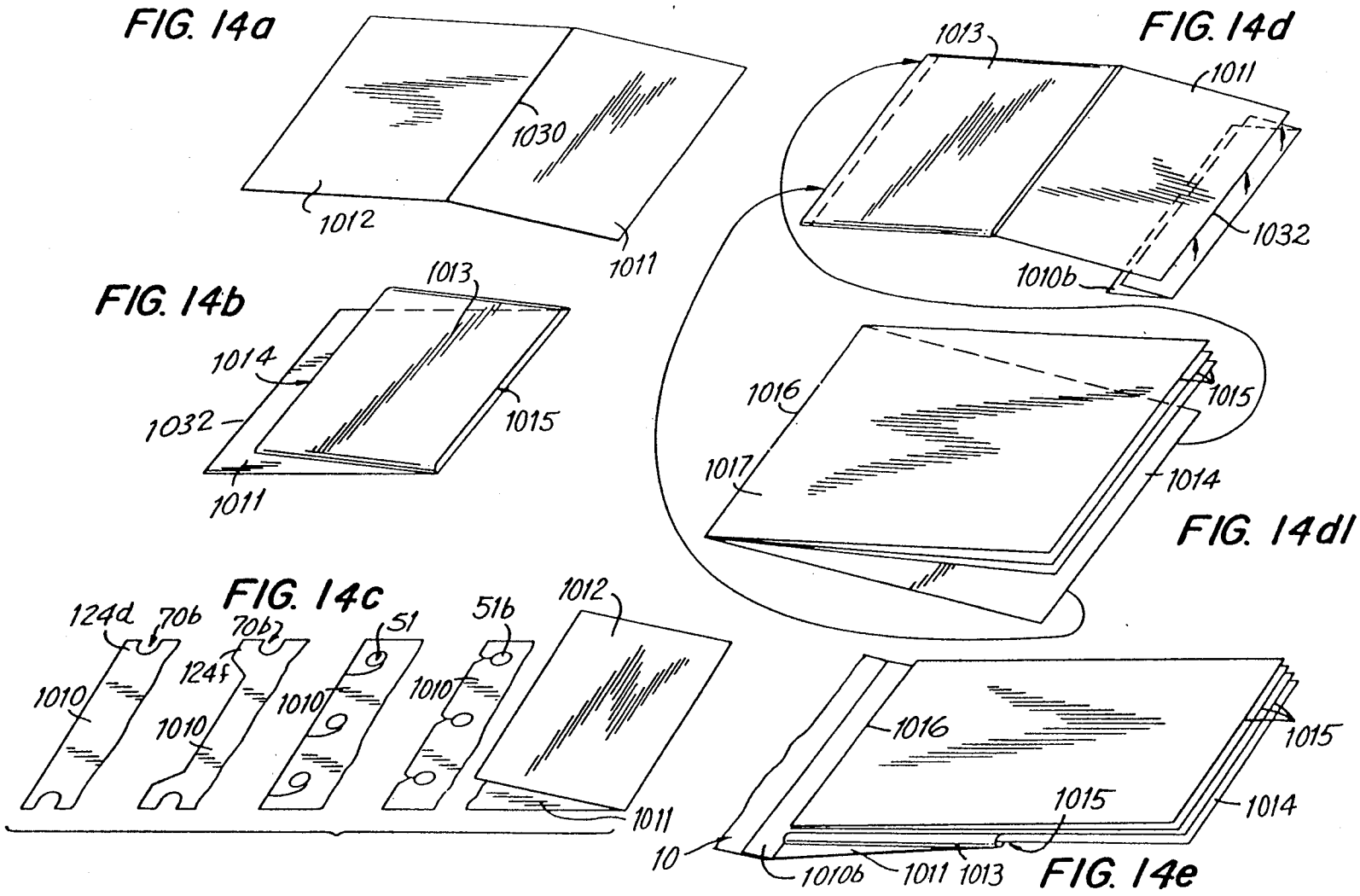
FIG. 14*a* shows the beginning formation of a simple hyperflap formed as the combination of two rectangular surfaces connected along a lateral folded edge.
FIG. 14*b* shows the HyperFlap of type shown in FIG. 14*a*, HyperFlapUni2OF, in which one of the surfaces is a mounting surface constructed with a pocket.
FIG. 14*c* shows a HyperFlapUni2OF style HyperFlap in which the binding edge is formed from one of any of the detailed semi-permanent binding edges.
FIG. 14*d* shows the HyperFlapUni2OF of FIG. 14*a* in which a mini-flap is implemented as an attachable adhesive strip.

A HyperFlapUni2OF is simply a rectangular surface folded in half. FIG. 14*a*, shows the beginning formation of just such a simple construction. The folded rectangle is formed by the contiguous arrangement of two rectangular surfaces, 1012 and 1011 along one common perimeter edge, 1030. FIG. 14*b* shows the HyperFlap of FIG. 14*a* in which the surface 1012 is handled as a mounting surface formed with a pocket 1013. The pocket surface is extended out and to the right, over surface 1011. In FIG. 14*c*, the binding edge, 1032, is formed with any one of a number of semi permanently attachable binding means, surface 1010 with slot 70*b* and peninsula tab 124*d*, surface 1010 with slot 70*b* and peninsula tab 124*f*, surface 1010 with hold pattern 51, and surface 1010 and hole pattern 51*b*, where any of these binding edges may be connected to the broken away orientation flap, 1011.

FIG. 14*d* shows the HyperFlapUni2EF of FIG. 14*a* in which a mini-flap is implemented as an attachable adhesive strip, 1010*b*, attached to lateral edge 1032. FIG. 14*d*1 shows the HyperFlap of FIG. 14*d* in which a page set, 1017, comprised of pages 1015, is bound along one edge, 1016, and possessing a tongue page, 1014, is insertable along the dotted lines into the pocket, 1013, of the HyperFlap of FIG. 14*d*. FIG. 14*e* shows the HyperFlap of FIG. 14*d* with the page set of FIG.

14*d*1 inserted, where said flap is positioned out and to the right of the host surface to which it is attached. The flap is attached to a surface, 10, via adhesive mini-flap, 1010*b*.

Figure 14F:
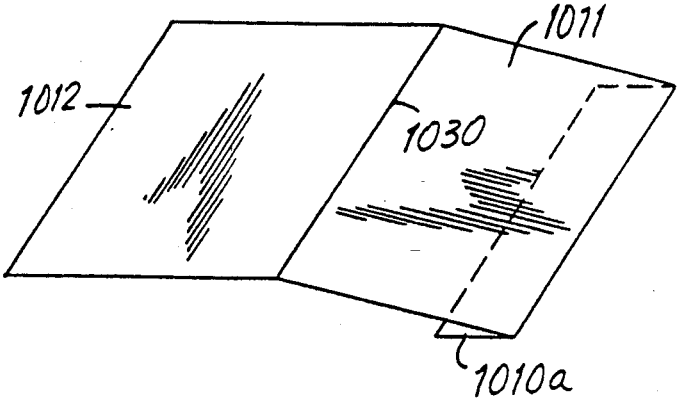
FIG. 14*f* shows a HyperFlapUni2OF surface comprised of a single folded rectangular surface comprising a mounting surface for mounting a second mounting surface thereon, and an orientation flap and a second mini-flap for tongue or adhesively mounting the HyperFlap surface to a second host surface.
Figure 14G:
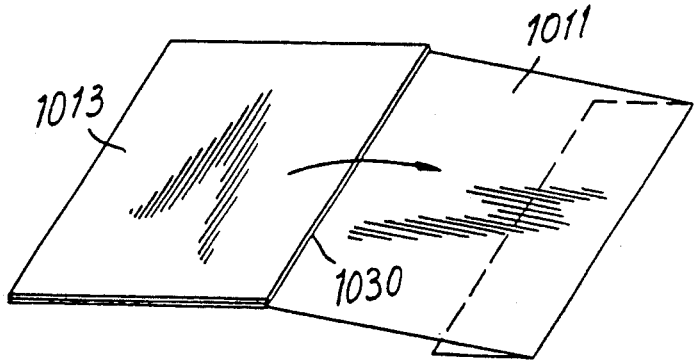
FIG. 14*g* shows the HyperFlap of FIG. 14*f*, in which the mounting surface is implemented as a pocket.
Figure 14H:
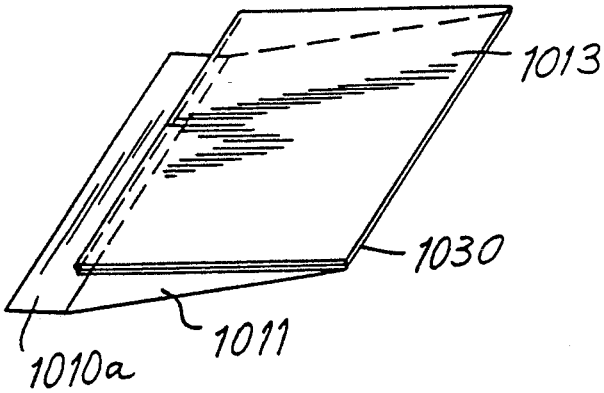
FIG. 14*h* shows the HyperFlap of FIG. 14*g* in a folded out, and extended position.

FIG. 14*f* shows a HyperFlapUni2OF surface comprised of a single folded rectangular surface comprising a mounting surface, 1012, for mounting a second mounting surface thereon, and an orientation flap,1011, and a second mini-flap, 1010*a*, for tongue or adhesively mounting the HyperFlap surface to a second host surface. FIG. 14*g* shows the mounting surface of FIG. 14*f* fitted with a pocket. And FIG. 14*h* shows this mounting surface positioned out and to the right, folded over lateral edge 1030.

One side is a mounting surface and the other is treated as an orientation flap. The orientation flap may have a mini-flap or an adhesive strip attached to it for mounting on a host. The mounting surface may have adhesive or be receptive to adhesive or possess a pocket for receiving a tongue from a second mounting surface. Any of the above mentioned mounting surfaces may have stacked arrays of repositionable notes mounted thereon. In one implementation, a rectangular surface is mounted with stacked arrays of repositionable notes. This surface is adhesively attached to the mounting surface of a HyperFlapUniOF type surface, which it itself attached via an adhesive strip to the right side cover of a host desk top information handling device.

Figure 15A:
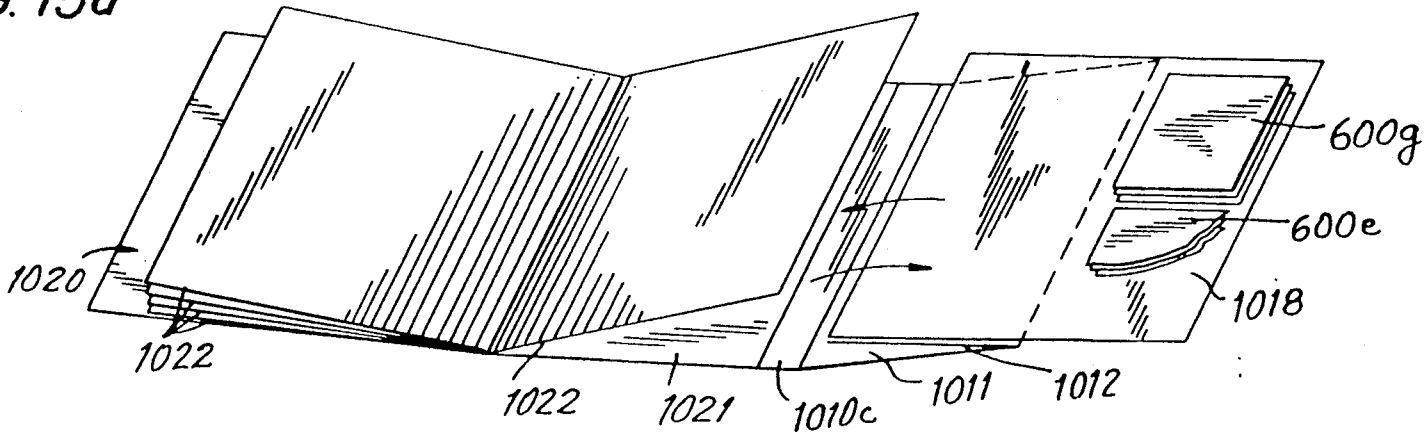
FIG. 15*a* shows a desk information handling object with pages and a hyperflap of the construction of FIG. 14*f*, where the mounting surface has a second mounting surface attached thereon said second mounting surface itself having an array of stacks of Post-it(TM) notes attached thereon.

FIG. 15*a* shows a desk information handling object, 1020, with pages,1022, and a hyperflap of the construction of FIG. 14*f* where the mounting surface has a second mounting surface, 1018, attached thereon, said second mounting surface itself having an array of stacks of Post-it( TM ) notes attached thereon, 600*g* and 600*e*.

Figure 15B:
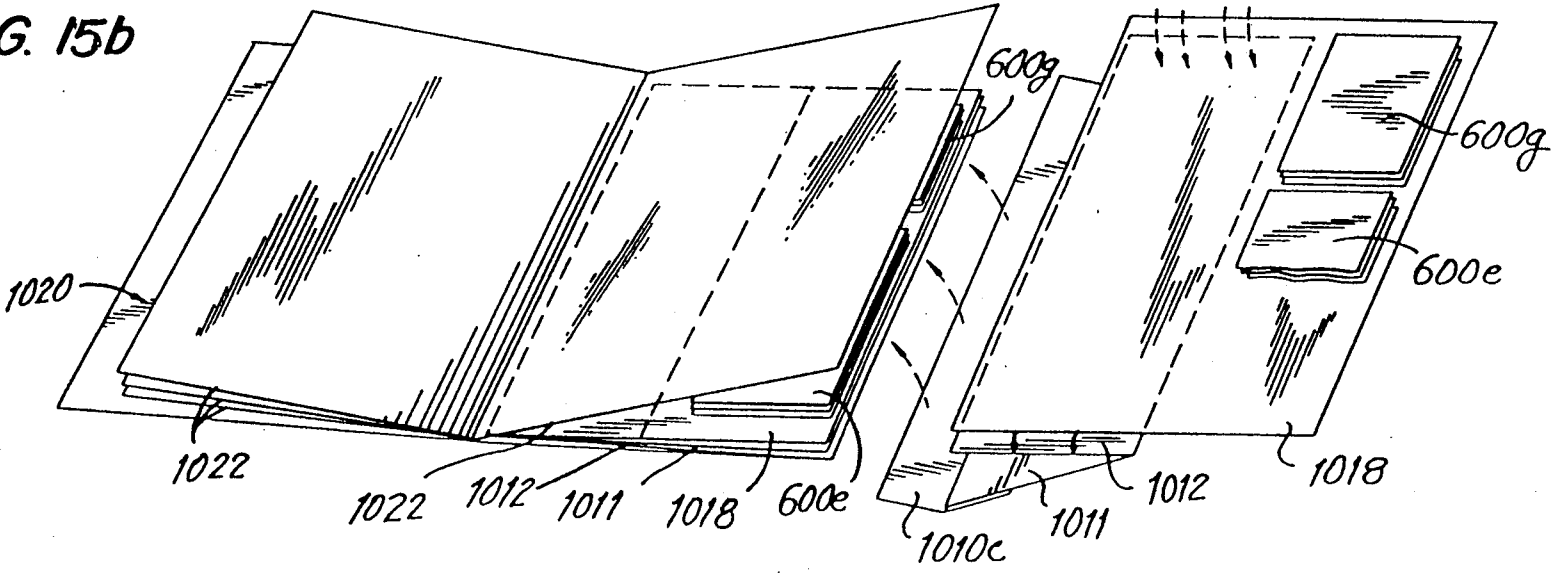
FIG. 15*b* shows the means for constructing the device of FIG. 15*a*, where the second mounting surface is shown in exploded view for attaching to the mounting surface of the HyperFlap and the mini-flap of the mounting surface shown for attaching to the host information processing object.

FIG. 15*b* shows the means for constructing the device of FIG. 15*a* where the second mounting surface, 1018, is shown in exploded view for attaching to the mounting surface of the HyperFlap, 1012, and the mini-flap of the mounting surface,1010*c*, is shown for attaching to the host information processing object surface 1021. FIG. 15*b* shows an explosion of the flap attached to the host information handling object, 1020, as it would actually be attached and inserted in a closed position, within the footprint of the cover of the object.

Figures 16A, 16B, 16C, 16D, 16E, 16F, 16G, 16H:
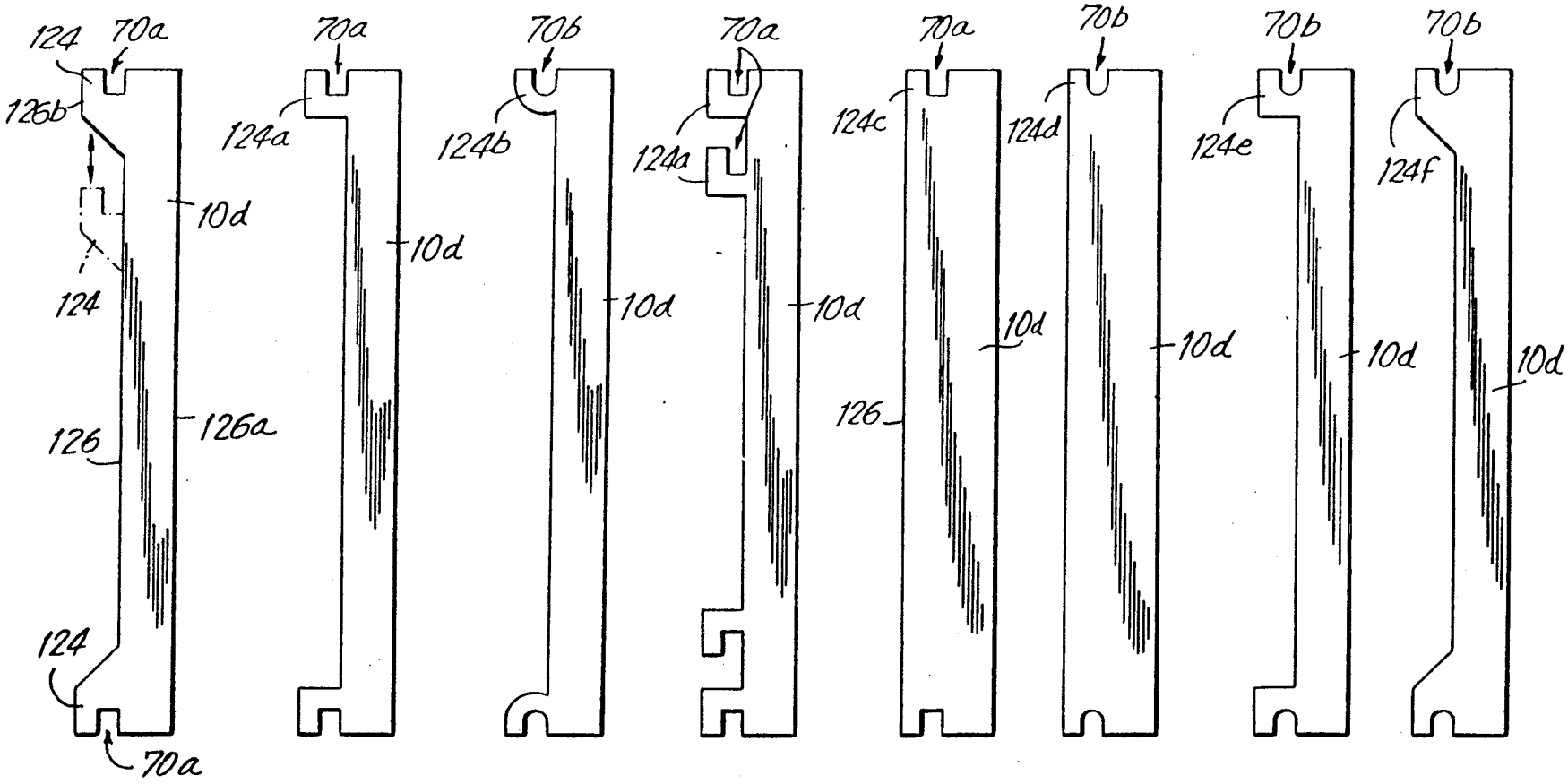
FIG. 16*a* shows a flex-lock hook set formed as a strip where each of the hooks is formed as a trapezoidal peninsula with rectangular slots. The dotted hook shows that it can be positioned anywhere along the edge.
FIG. 16*b* shows a flex-lock hook set formed as a strip where each of the hooks is formed as a rectangular peninsula with rectangular slots.
FIG. 16*c* shows a flex-lock hook set formed as a strip where each of the hooks is formed as a curved peninsula in the shape of "c" with "c" shaped curved slots.
FIG. 16*d* shows a flex-lock hook set formed as a strip where a plurality of the hooks is formed, two hooks to a set, in opposing concave positions, as rectangular peninsulas with rectangular slots.
FIG. 16*e* shows a flex-lock hook set formed as a strip where each of the hooks is formed in parallel opposing edges of a rectangular surface, where the hooks thus formed have rectangular slots.
FIG. 16*f* shows a flex-lock hook set formed as a strip where each of the hooks is formed in parallel opposing edges of a rectangular surface, and where the hooks thus formed have "c" shaped curved slots.
FIG. 16*g* shows a flex-lock hook set formed as a strip where each of the hooks is formed as a rectangular peninsula with "c" shaped curved slots.
FIG. 16*h* shows a flex-lock hook set formed as a strip where each of the hooks is formed as a trapezoidal peninsula with "c" shaped curved slots.
Figures 16H, 16I, 16J, 16K, 16L, 16M:
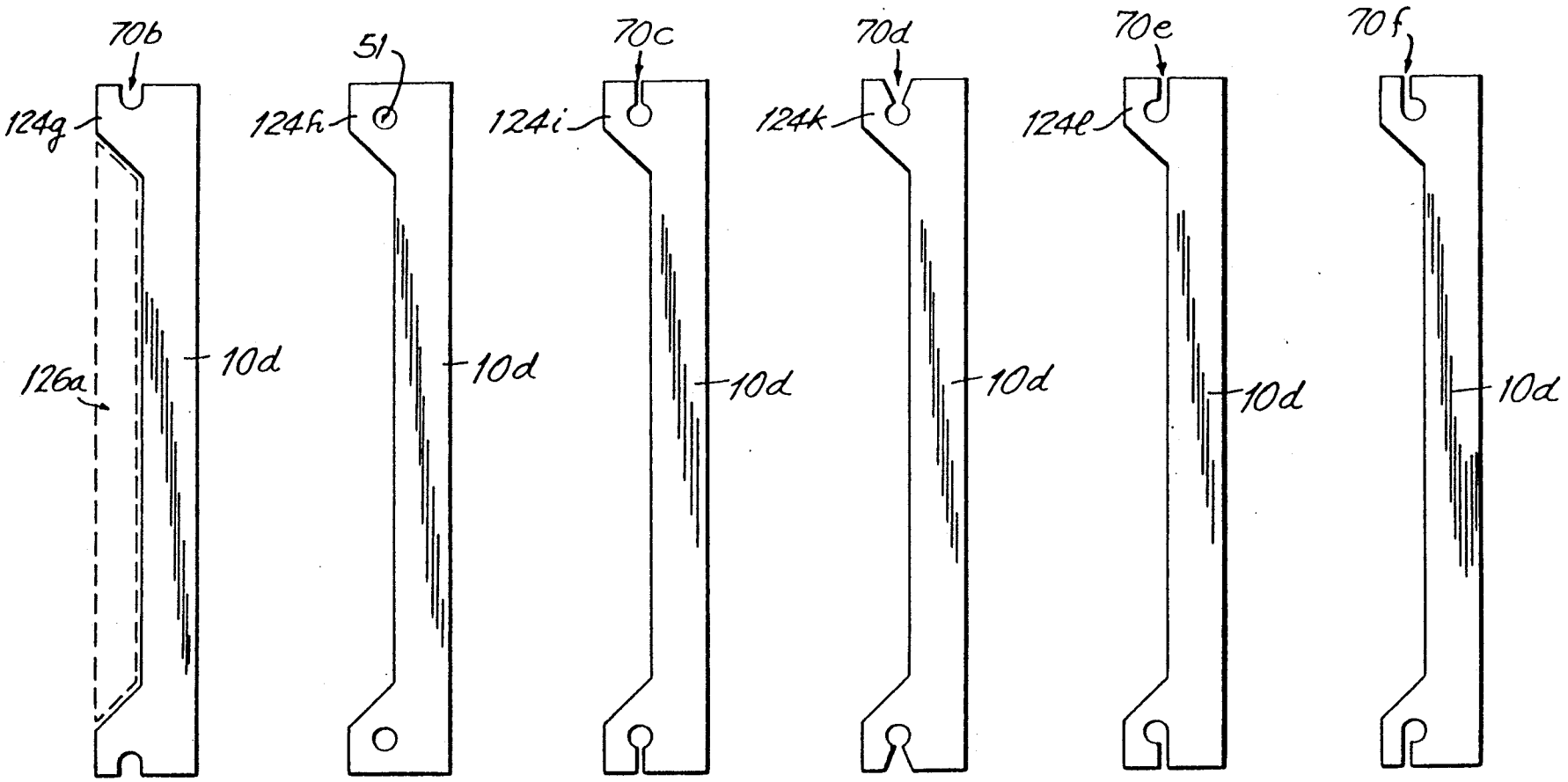
FIG. 16I shows a flex-lock hook set formed as a strip where each of the hooks is formed as a trapezoidal peninsula tab with "c" shaped curved aperture slots. The dotted area shows the inter-hook gap for avoiding all other rings of a host binding.
FIG. 16J shows the flex lock strip of 16I with closed holes.
FIG. 16*k* shows a slot aperture of key hole shape where the aperture is a channel centered on a hole.
FIG. 16*l* shows a slot aperture of key hole shape where the aperture is a wedge and a hole.
FIG. 16*m* shows a slot aperture of key hole shape in which the aperture is a channel offset below and connected to a hole.

FIGS. 16*a–n* show various embodiments of a flex-lock strip for attaching to a surface. In FIG. 16*a*, the flex-lock strip 10 is formed with the preferred embodiment of the hook set, where the hook is formed as a trapezoidal peninsula 124 with rectangular slots 70*a*. The strip 10*d* has an edge 126*a* which may be adhesively attached or welded to a second surface to form a flex-lock leaf. The dotted peninsula labeled 124 shows that the hooks may be positioned anywhere along the flex-lock binding edge. In FIG. 16*b* the hook set is a rectangular peninsula, 124*a*, formed in a "u" shape, with rectangular slot 70*a*. In FIG. 16*c* the hook set is a "c" shaped curved form with a "c" shaped curved slot 70*b*. In FIG. 16*d*, the hook sets are each double sets of hook type 124*a* where each hook has a rectangular slot 70*a*. In FIG. 16*e*, edge 126 is collinear with the edge 126*b* of the peninsula hook. This flex-lock strip would support a host binding with only 2 rings. FIG. 16*f* is a variation of the 2 ring strip of FIG. 16*e*, where the slot is a "u" or "c" shaped curved slot. FIG. 16*g* has a peninsula hook formed with a rectangular shape, 16*e*, and a "U" shaped curved slot, 70*b*. In FIG. 16*h*, the trapezoidal peninsula hook 124*f*, is formed with a "U" shaped curved slot 70*b*. In FIG. 16I, interhook gap 126*a* is shown as the area for tertiary hook avoidance. The trapezoidal peninsula hook 124*g* is complemented by a curved aperture 70*b*.

FIG. 16J shows a standard hole, 51, cut into a Hook set where the aperture is a closed periphery.

FIG. 16*k* shows a concave inner periphery in which the aperture is formed by a channel and hole, 70*c*. The peninsula tab hook 124I is trapezoidal in form.

FIG. 16*l* shows a concave inner periphery in which the aperture is formed by a wedge and a hole, 70*d*. The peninsula tab hook 124*k* is trapezoidal in shape.

FIG. 16*m* shows a concave inner periphery formed by a channel and hole in which the channel is offset from and below the hole, 70*e*. The Peninsula hook tab 124*k* is trapezoidal in shape.

FIG. 16*n* shows a concave inner periphery in which the aperture is formed as a channel and a hole in which the channel is offset above the hole. The Peninsula hook tab 124M is trapezoidal in shape.

In each and every variation of FIGS. 16*a*–16*n*, the strip thus formed is capable of being bound to another surface and inserts and deinserts by flexing the strip to shorten the length between the cut slots and extending the strip again to its normal length.

Figure 17A:
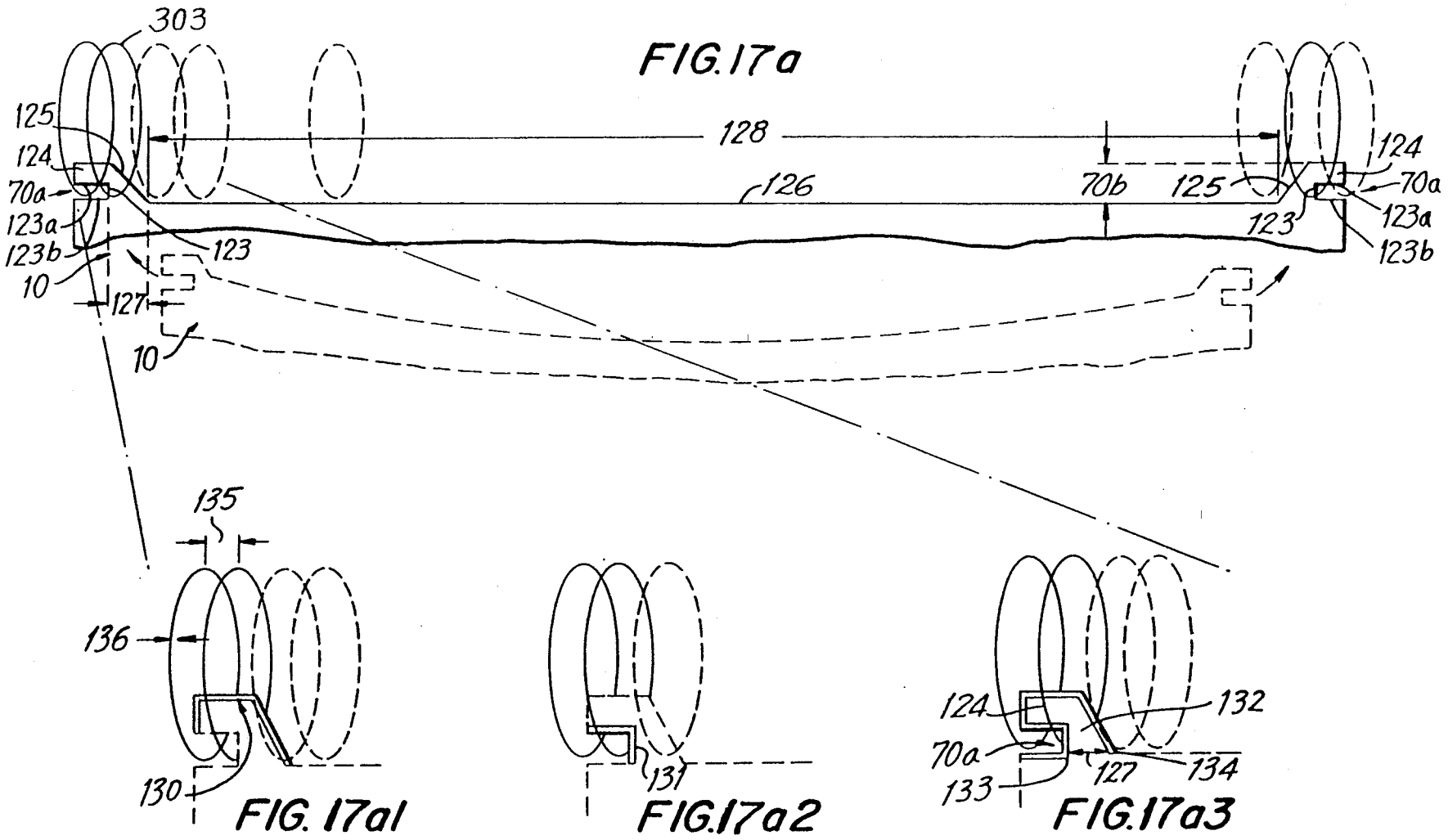
FIG. 17*a* shows a two slot hook set on a break away cut of a host surface. The flexed position shows the pre-insertion or post-removal position of the surface with respect to the host ring mechanism. Three additional explosions of a hook,17 a1,a2,a3 show the inner concave periphery and aperture, the outer convex periphery, and the details of the peninsula hook tab, the peninsula base, ring width, and inter-hook distance.

FIG. 17*a* shows a mounting surface break away 10, in which a double hook set is implemented, 70*a*. The hooks are shown attached to a ring, spiral 303 for purposes of example, where only a portion of the rings are shown. The hook is formed as a U shaped slot which has an inner edge 123 and parallel edges 123*a* and 123*b*. The hook is formed as a "peninsula" shaped as a rectangle in this rendering, 124. The peninsula joins the outer edge 126 with a slanted line 125 creating a clip base of width 127 and depth 70*b*. The width is sized to fit, at a minimum, between the two closest rings of the host binding. The combination of the slanted slot formed by edge 125 and 126 permits the surface to be retained by any two hooks and two rings, without any interference with any other rings or posts of the host binding mechanism. The surface is shown flexed for insertion or after removal in dotted outline form. The inter-hook distance, 128, is shown.

FIG. 17*a*1 shows an explosion in which the outer, convex periphery is highlighted. Ring diameter 136 and inter ring distance 135 are shown.

FIG. 17*a*2 shows an explosion in which the inner, concave periphery is highligted.

FIG. 17*a*3 shows the hook tab peninsula in exploded form in which the hook peninsula is shown, the hook base, and the two points at which the hook base connect to the leaf binding edge. The aperture formed by the inner, concave periphery is shown.

Figure 18B:
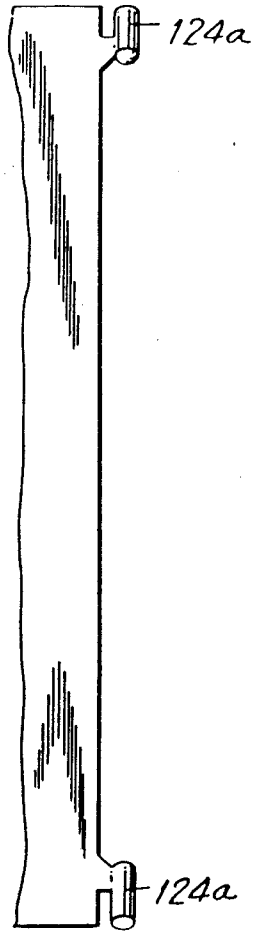
FIG. 18*b* shows a hook set in which the "peninsula" of the hook is formed in a tube like shape.
Figure 18A:
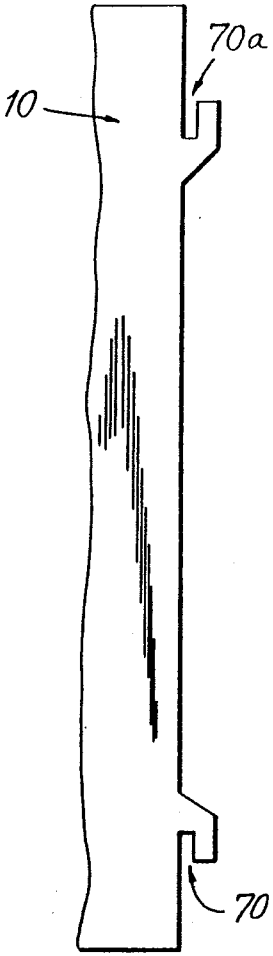
FIG. 18*a* shows a two slot hook set where the hooks are offset from the corners of the host surface.

FIG. 18*a* shows a break away mounting surface with the hook set, 70*a*, offset from the corners.

FIG. 18*b* shows a hookset in which the "peninsula" portion of the hook, 124*a*, is formed as a tube.

Figure 19B:
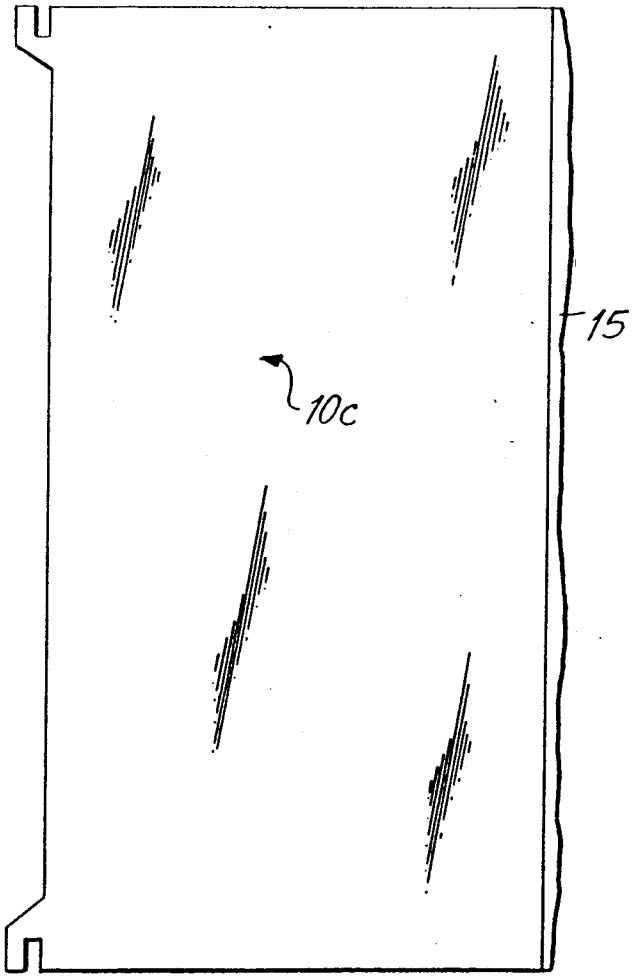
FIG. 19*b* shows a host surface with a break away section of an orientation flap in which the surface is a clear plastic section allowing "see through".
Figure 19A:
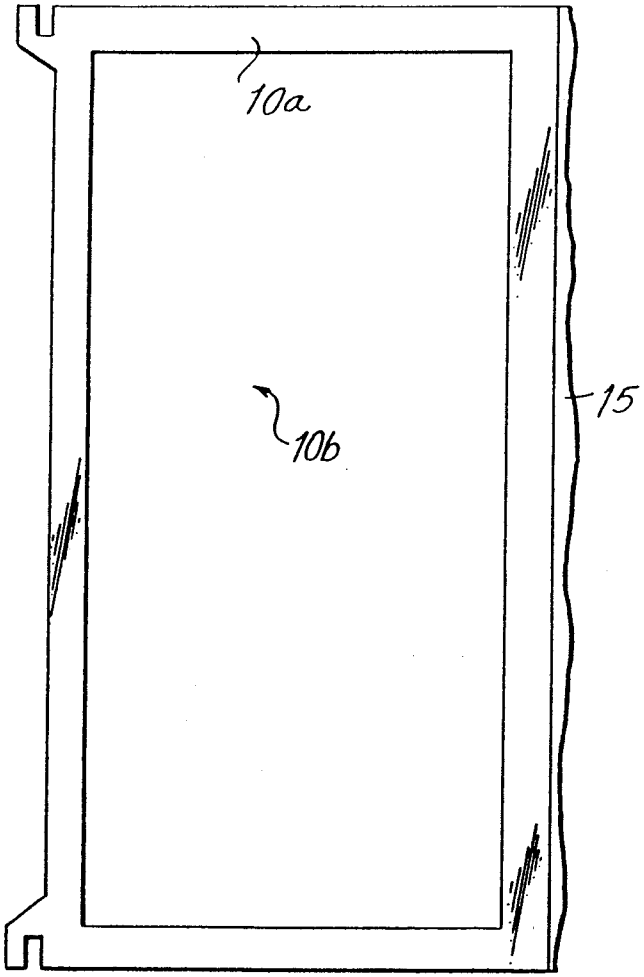
FIG. 19*a* shows a host surface with a break away section of an orientation flap in which the surface is a picture frame allowing "write through".

FIG. 19*a* shows a surface acting as an extension flap, 10*a*, to which a breakaway portion of an extension flap, 15, is attached. The extension flap 10*a* is implemented as a "window frame" with an open portion, 10*b*, which enables "write through".

FIG. 19*b* shows 10*c*, an extension flap, implemented as a clear piece of plastic that allows for see through.

Figures 20, 20A, 20B, 20C, 20D, 20E:
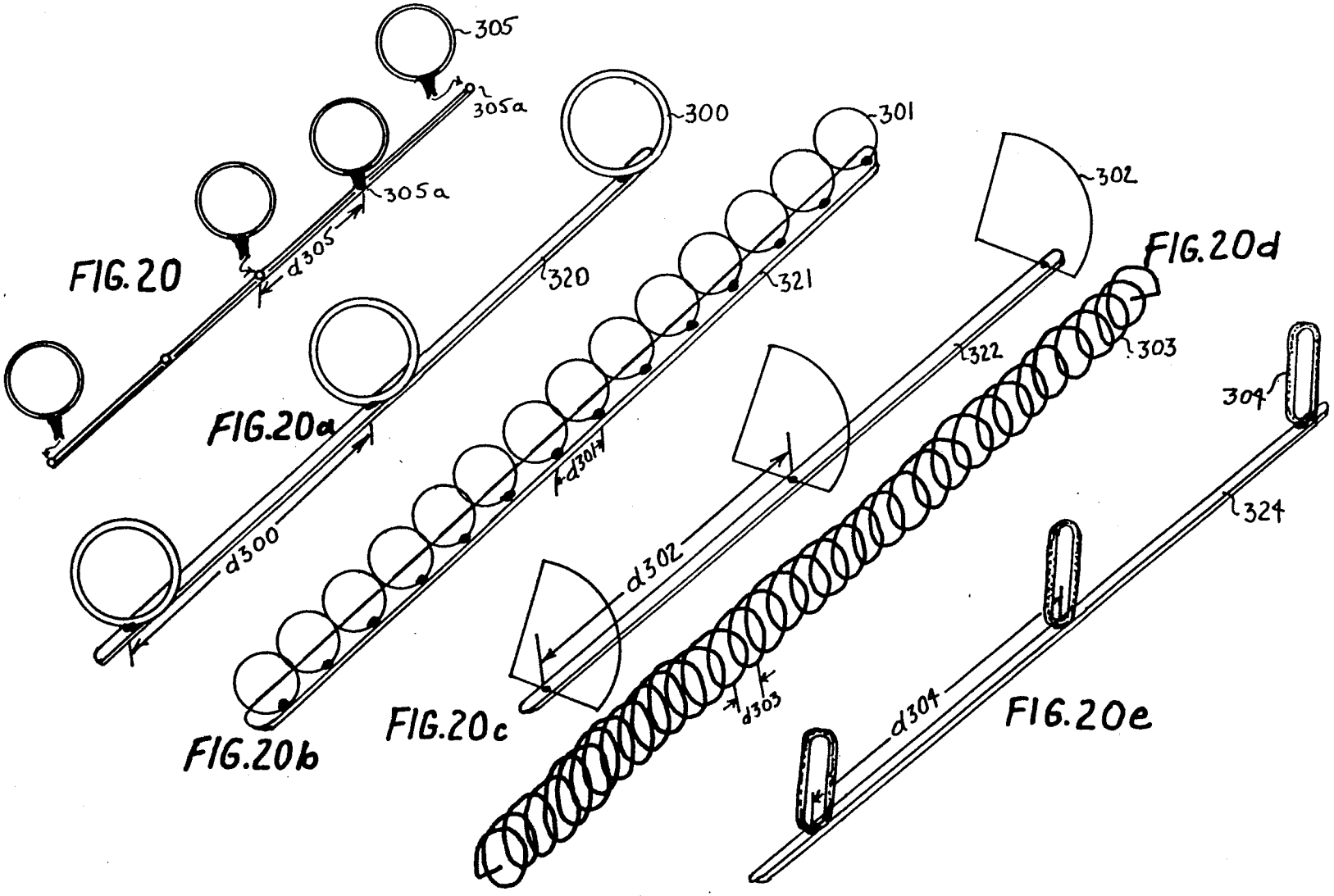
FIG. 20 shows a variety of application specific ring types of either open/close design or closed loop construction.
FIG. 20*a* is a traditional loop ring design.
FIG. 20*b* is a ½" inch multi-ring design.
FIG. 20*c* is a slant-D ring design.
FIG. 20*d* is a traditional spiral, closed loop design.
FIG. 20*e* is an oval shaped ring design.

FIGS. 20, 20*a*, 20*b*, 20*c*, 20*d*, and 20*e* show ring, multiring, slant-D, spiral, and oval ring style coupling structures for attaching surfaces with holes constructed according to the invention. In particular, the two "closed loop" designs are the individually inserted or plurality ring array of FIG. 20, and the spiral of FIG. 20*d*. However, in the preferred embodiment of this invention, all rings including 300, 301, 302, 304, and 305 supported on their bases 320, 321, 322, and 324, with distances between rings d300, d301, d302, d304, and d305 may be of a simple closed loop design. The advantage of this is that the rings can be made light, inexpensive, and from plastic enabling a variety of ring sizes to be constructed inexpensively without costly tooling. FIG. 20 shows a simple embodiment of a plurality of closed loops which may be implemented as a set of individually mounted ring/stem components, with stems inserted into coupling structures 305*a*.

Figure 21B:
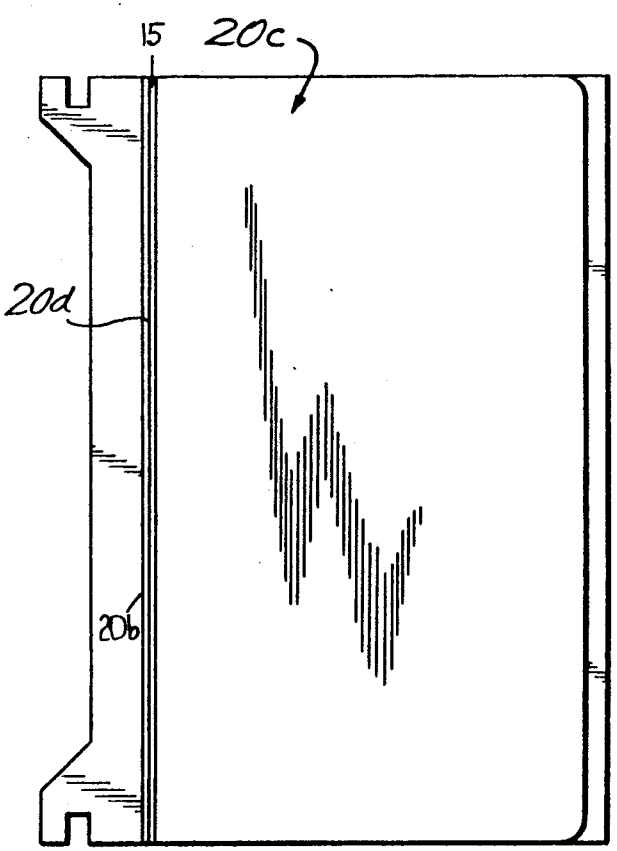
FIG. 21*b* shows the flex-lock strip of FIG. 21*a* fixedly attached to the pocket of 21*a*.
Figure 21A:
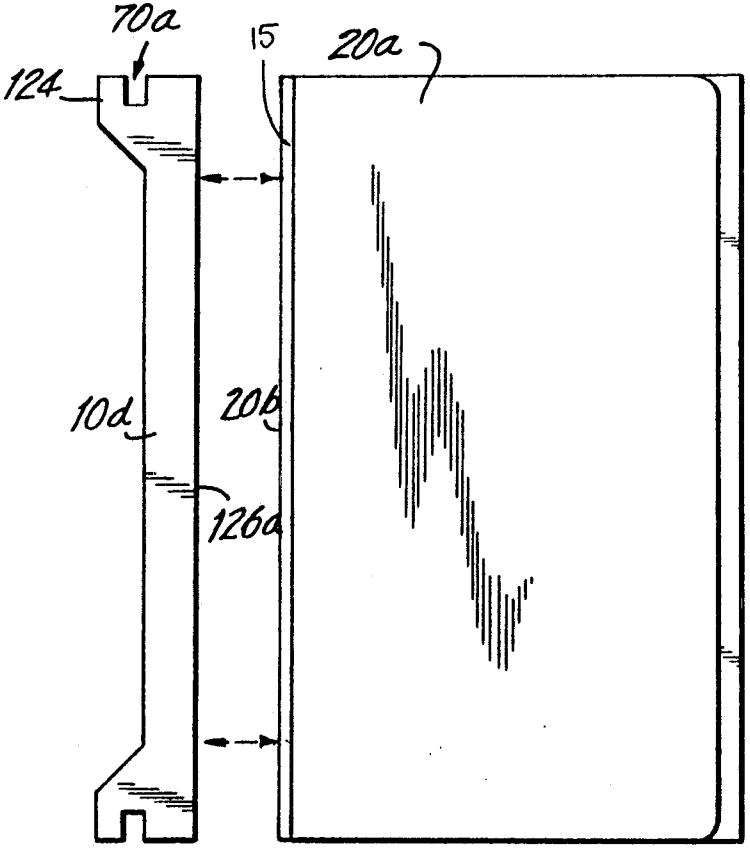
FIG. 21*a* shows one of the flex-lock strips of FIG. 16 for adhesively attaching or welding to a pocket surface.

FIG. 21*a* shows a flex-lock strip 10*d* with edge 126*a* for attaching to a second surface, pocket 20*a*, where the edge 20*b* is the edge of the orientation flap, 15, to which the flex-lock strip is attached, in this case, by welding. FIG. 21*b* shows the completed HyperPage, 20*c*, with the weld joint 20*d*.

Figure 22:
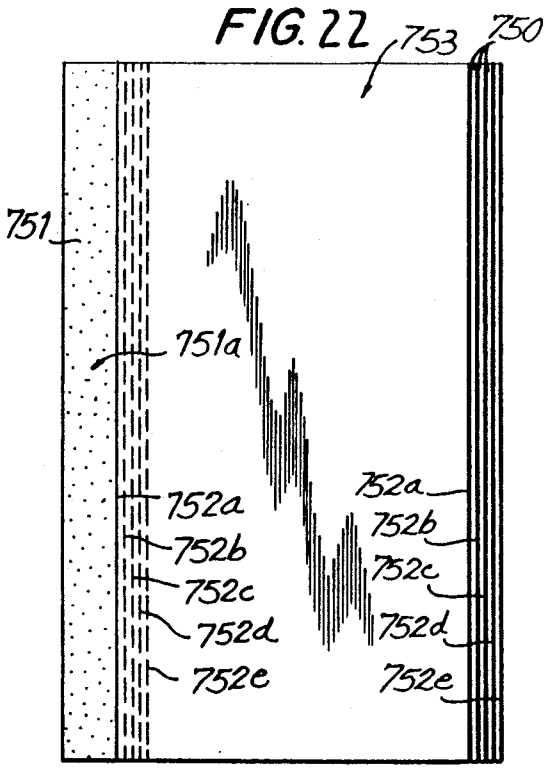
FIG. 22 shows a sheet set that is flat bound layering each sheet in an offset position and taping the stairstep edge thus formed.
Figure 22A:
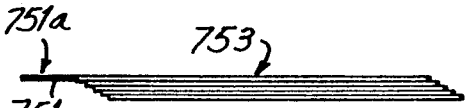
FIG. 22*a* shows a side view of 22 where the stairstep edge that is taped is shown, with a tape flap extending to the left of the bound edge, adhesive surface face up.
Figure 22B:
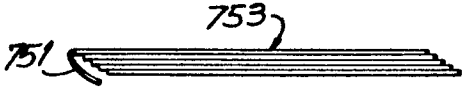
FIG. 22*b* shows the taped edge of 22*a* with the adhesive edge folded down and below the stair-step bound edge, adhesive surface face down.
Figure 22C:
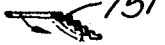
FIG. 22*c* shows just the adhesive portion of FIGS. 22*a* and 22*b*, with the tape edge in each of its two respective positions.
Figure 22D:
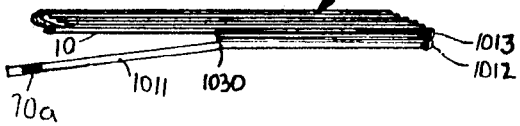
FIG. 22*d* shows the sheet set of 22, adhesively taped to a surface which is inserted into a HyperFlap according to the invention, in a flat fashion, where each of the pages may be turned.

FIGS. 22, 22*a*, 22*b*, 22*c*, and 22*d* depict the construction of a "floating page" where a databank is depicted comprising a flat bound set of sheets, preferably clear plastic sheets. In FIG. 22, single sheets or pages, 750, are layered one on top the next, and taped on one edge, with a piece of adhesive, 751, to form a flat binding. The adhesive has a sticky surface, face up, shown as 751*a*. The edges 752*a,b,c,d*,and *e* form a stair step finger index on the right side and a stair step binding on the left edge, where the left edges each allow length wise adhesion to the piece of tape. FIG. 22*a* shows the side view of 22 and FIG. 22*b* shows the side view of FIG. 22*a*, where the tape is folded back below the stair step edge, with adhesive side down, in order to permit mounting on a host surface. FIG. 22*c* shows a side view of the piece of adhesive tape, 751 in each of its two corresponding positions. The sheet set as a flat bound page array is shown as 753. In FIG. 22*d*, the sheet set, 753, is mounted on surface 10. The side view shows the sheet set inserted in a HyperFlapUni2OF as a "floating page".

Figure 23B:
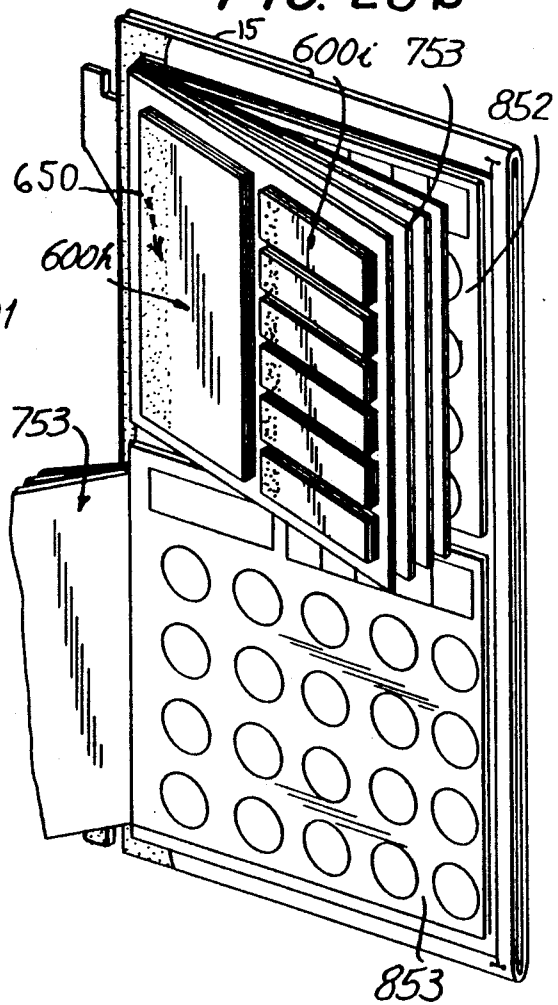
FIG. 23*b* shows the HyperFlapUni2OF of FIG. 23*a* where the folded card is inserted and the sheet sets are further comprised of electronic devices and stacked arrays of repositionable notes.
Figure 23A:
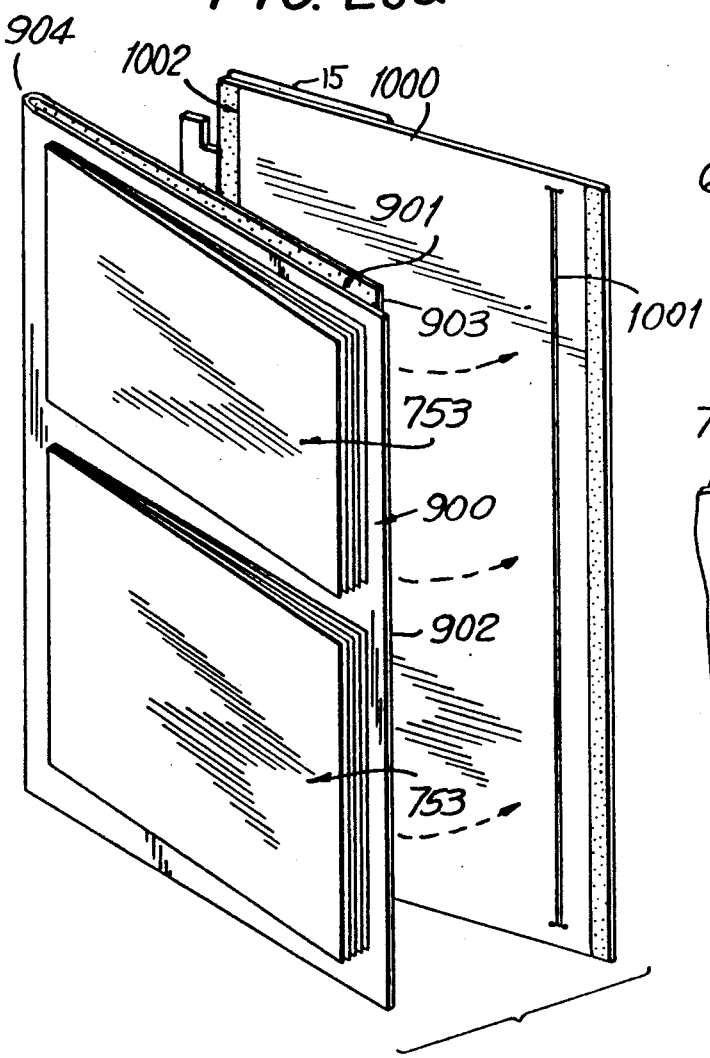
FIG. 23*a* shows a folded card with two sheet sets mounted on it, and a HyperFlapUni2OF implemented with a pocket formed as a band stretched from each of the respective parallel and opposing length wise edges, where the band further has a cut slit for receiving the width wise outer edge of the top surface of the insertable folded card.

FIGS. 23*a* and *b* show alternative application configurations. In each case the surface is configured differently to show the flexibility of use possible with a repositionable page according to this invention. FIG. 23*a* shows a HyperFlapUni2OF mounted with an envelop or pocket, 1000. The pocket has a lengthwise slit 1001. The figure shows a surface, 904, comprised of two rectangular surfaces 900 and 901, each with a respective outer edge 902 and 903. The pocket receives each of said two edges, 903 and 902, to permit the secure mounting of said surface, 904. Edge 903 is inserted as a tongue, into the envelop or pocket opening , 1002, and edge 902 is inserted into lengthwise slit 1001. In FIG. 23*b*, an alternative array of notes is shown, in perspective view, with note stacks 600*h* and 600*i*. Two different application specific calculators are shown 852 and 853, said each of said electronic devices is mounted as the corresponding "last page" of each of the sheet sets, 753. In the preferred embodiment, the glue edge of each of the sheets of the note stacks is on the left edge, 650. This allows the notes to be peeled from right to left as one would turn a page of a book. The glue edge 650 can extend from left to right any distance but must leave a peeling edge on the right sufficient to permit the selective removal of single notes from each stack of notes.

Figure 24C:
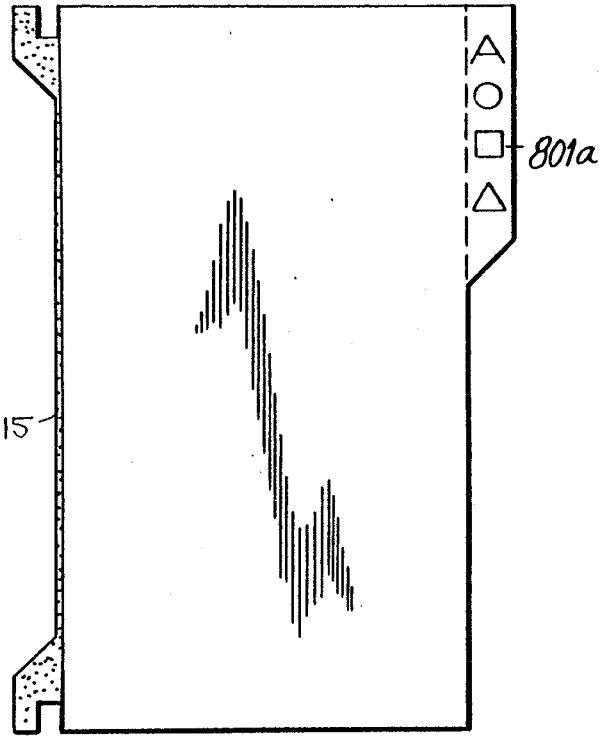
FIG. 24*c* shows the surface of FIG. 24*a* where the right edge is extended in order to provide a indexing surface for placing a label.
Figure 24B:
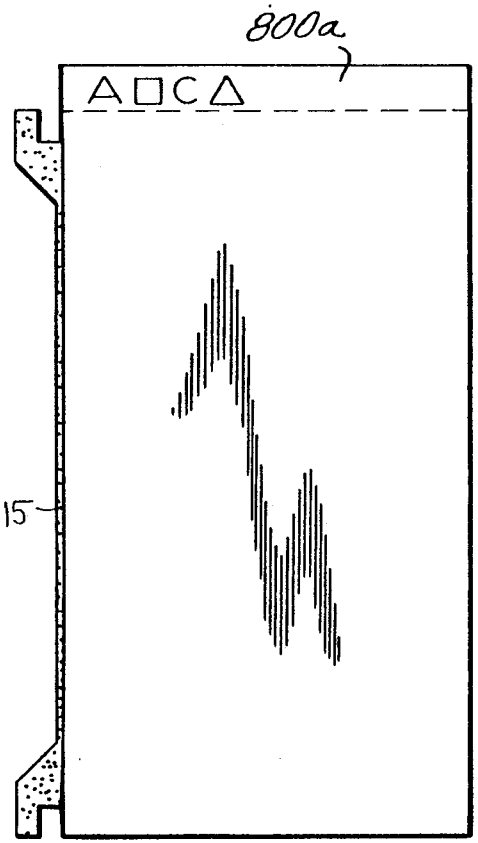
FIG. 24*b* shows the surface of FIG. 24*a* where the top edge is utilized as an indexing surface for placing a label.
Figure 24A:
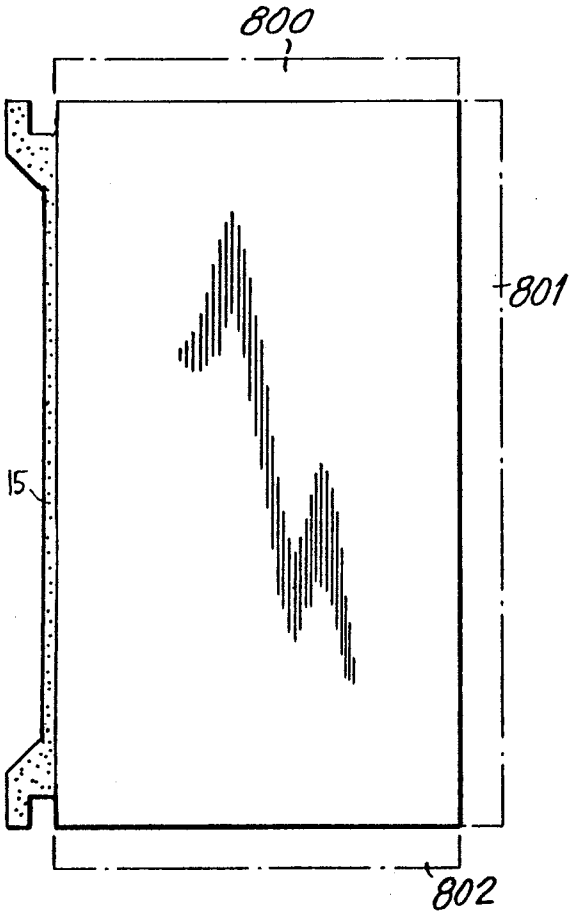
FIG. 24*a* shows a mounting surface with dotted sections showing extended sections of the surface usable for indexing the surface.

FIGS. 24*a,b*, and *c* show the construction of a Windowing Page with indexing tabs. In FIG. 24*a*, the three sections for visual indexing are show as areas 800, 801, and 802 depicted by dotted rectangular blocks. In FIG. 24*b*, a top index is shown in physical form as area 800*a*, with corresponding label. In FIG. 24*c*, a partial right hand edge index is shown, 801*a*, with corresponding label.

Figure 25B:
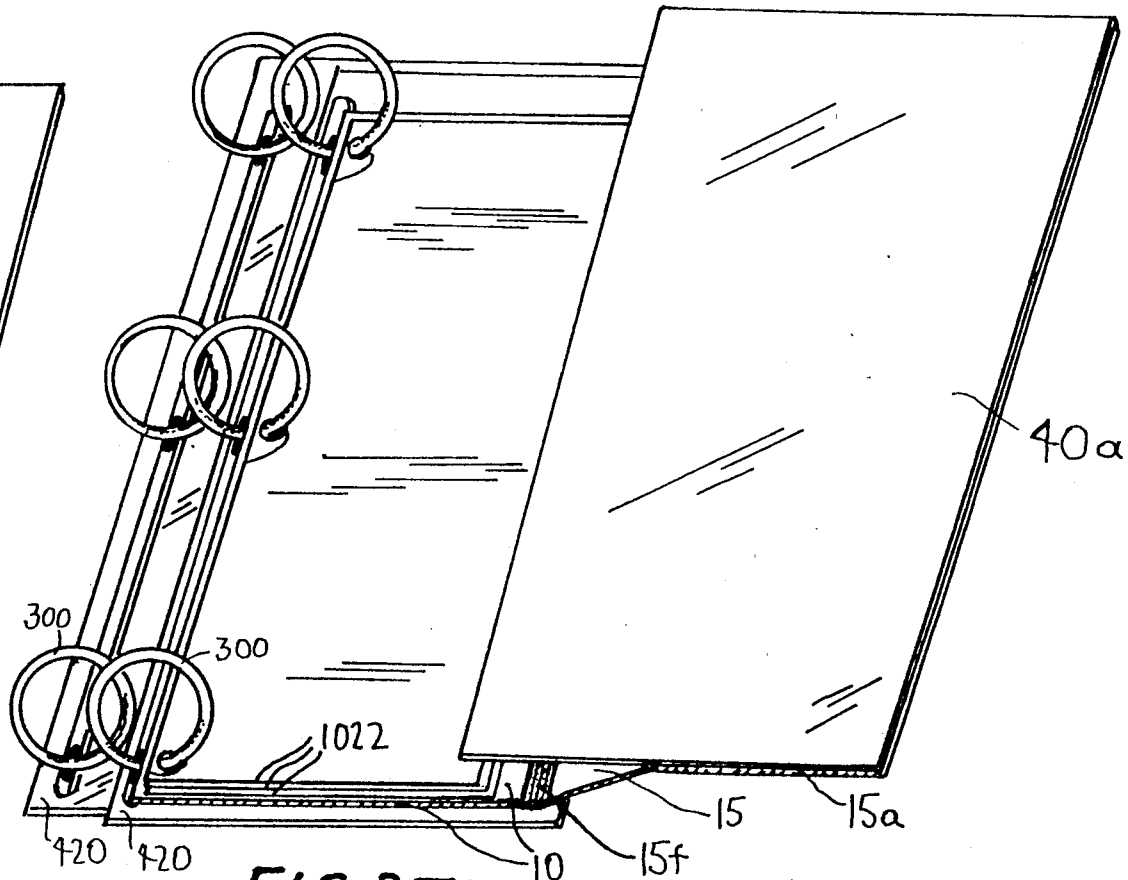
FIG. 25*b* shows the card and ring set implemented according to FIG. 25*a* stacked in an interleaved manner as "notebook shelves" with a HyperFlap according to the invention, attached thereto.
Figure 25A:
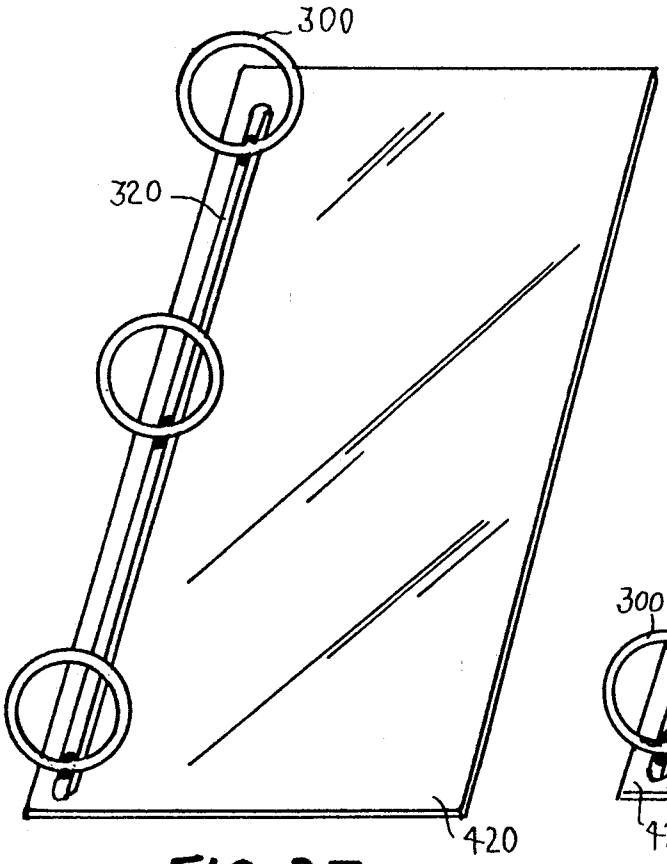
FIG. 25*a* shows a bottom card, 420, with closed loop ring set 320/300.

FIG. 25*a* shows a bottom card 420 mounted with a closed loop ring set of base 320 and ring 300. The ring set is mounted flush with the edge.

FIG. 25*b* shows a set of card/ring binders according to FIG. 25*a* stacked in an interleaved fashion as "notebook shelves". The stacking is enabled by the slim ring base that is flush mounted to the base card. A Windowing mounting surface 40*a* is shown in extended position.

The dynamically reconfigurable book cover, binding, and semi-permanently attachable leaves form a system ideally suited for the implementation of non-linear, heterogenous, and mixed medial physical information handling systems that feature highly visible access and the ability to quickly reorder the ordinal sequence of the surfaces without requiring the opening and closing of a host binding. One skilled in the art will appreciate that the present invention can be practiced by other than the embodiments described, which are presented for the purpose of illustration and not of limitation, and the present invention is limited only by the claims which follow.

What is claimed is:

1. An attachment for a book, said book having at least one coupling location, said attachment comprising:

a plate having a face and perimeter features with at least two opposing edges, and an orientation member having at least two opposing attachement locations defining first and second orientation member attachement locations, said second orientation member attachment location further comprising pivotal attachment means for allowing said orientation member to be removed from and subsequently reinserted into said book at said book coupling location; wherein, said orientation member first attachment location is pivotally attached to said plate between said opposing edges; such that:

when said orientation member second attachment location is pivotably attached to said book at said book coupling location, said plate may be placed in any one of at least two substantially adjacent, coplanar positions to either side of said book coupling location, with preservation of orientation of said plate face and perimeter features in both positions.

2. The attachment of claim 1 wherein said pivotal attachment means is an insertable hook structure.

3. The attachment of claim 1 wherein said pivotal attachment means is a set of holes for placement in a ring binding.

4. The attachment of claim 1 wherein said pivotal attachment means is a set of holes, where each hole further comprises a cutout for the insertion and deinsertion of the hole on a closed ring binding.

5. The attachment of claim 1 wherein said pivotal attachment means is a strip pivotally attached to said second orientation member attachment location.

6. The attachment of claim 5 wherein said strip has adhesive properties.

7. The attachment of claim 5 wherein said strip is formed from a piece of tape.

8. The attachment of claim 1 wherein said first orientation member attachment location further comprises at least one structural protrusion formed thereon for enabling a locking means to securely position said plate in it's coplanar positions.

9. The attachment of claim 1 wherein said attachment is formed from one piece of material and said pivotal attachment means are formed in the material.

10. The attachment of claim 1 wherein said attachment is formed from one piece of material and said first pivotal attachment means is formed as a hinged fold in the material.

11. The attachment of claim 1 wherein said attachment is formed from at least two pieces of material.

12. The attachment of claim 1 wherein said plate of said attachment further comprises a pocket.

13. The attachment of claim 1 wherein said plate further comprises an array of at least one stack of repositionable notes.

14. The attachment of claim 1 wherein said plate further comprises an electronic device.

15. An attachment for a book, said book having at least one coupling location, said attachment comprising:

a mounting plate, having a mounting face for receiving a second plate thereon, and perimeter features including at least one edge, a second plate having a top face, a bottom face and perimeter features with at least two opposing edges, and an orientation member having at least two opposing attachment locations defining first and second orientation member attachment locations, said orientation member further comprising pivotal attachment means at said second orientation member attachment location for allowing said orientation member to be removed from and subsequently reinserted into said book at said book coupling location; wherein, said orientation member is pivotally attached to said mounting plate along said at least one edge at said first orientation member attachment location; and said mounting plate face is attached to said bottom face of said second plate, with said at least one edge lying between said at least two opposing edges of said second plate, such that:

when said orientation member second attachment location is pivotally attached to said book at said book attachment location, said second plate may be placed in any one of at least two substantially adjacent, coplanar positions to either side of said book attachment location, with preservation of orientation of said second plate top face and perimeter features in both positions.

16. The attachment of claim 15 wherein said pivotal attachment means is an insertable hook structure.

17. The attachment of claim 15 wherein said pivotal attachment means is a set of holes for placement in a ring binding.

18. The attachment of claim 15 wherein said pivotal attachment means is a set of holes, where each hole further comprises a cutout for the insertion and deinsertion of the hole on a closed ring binding.

19. The attachment of claim 15 wherein said pivotal attachment means is a strip pivotally attached to said second orientation member attachment location.

20. The attachment of claim 19 wherein said strip has adhesive properties.

21. The attachment of claim 19 wherein said strip is formed from a piece of tape.

22. The attachment of claim 15 wherein said first orientation member attachment location further comprises at least one structural protrusion formed thereon.

23. The attachment of claim 15 wherein said attachment is formed from one piece of material and said pivotal attachment means are formed in the material.

24. The attachment of claim 15 wherein said attachment is formed from one piece of material and said first pivotal attachment means is formed as a hinged fold in the material.

25. The attachment of claim 15 wherein said attachment is formed from at least two pieces of material.

26. The attachment of claim 15 wherein said mounting plate of said attachment further comprises a pocket.

27. The attachment of claim 15 wherein said second plate further comprises an array of at least one stack of repositionable notes.

28. The attachment of claim 15 wherein said second plate further comprises an electronic device.

29. An attachment for a book, said book having at least one coupling location, said attachment comprising:

a first plate having a face and perimeter features with at least two opposing edges, an orientation member having opposing attachment locations defining first and second orientation member attachment locations, and an extension member having at least a first and a second attachment location, said extension member further comprising coupling means at said second extension member attachment location for allowing said extension member to be removed from and subsequently reinserted into said book at said book coupling location; wherein:

said orientation member first attachment location is pivotally attached to said plate between said opposing edges of said plate and said orientation member second attachment location is pivotably attached to said extension member at said extension member first attachment location; such that:

when said extension member second attachment location is coupled to said book at said book coupling location, said plate may be placed in any one of at least two substantially adjacent, coplanar positions to either side of said first extension member attachment location, with preservation of orientation of said plate face and perimeter features in both positions.

30. The attachment of claim 29 wherein said coupling means is an insertable hook structure.

31. The attachment of claim 29 wherein said coupling means is a set of holes for placement in a ring binding.

32. The attachment of claim 29 wherein said coupling means is a set of holes, where each hole further comprises a cutout for the insertion and deinsertion of the hole on a closed ring binding.

33. The attachment of claim 29 wherein said coupling means is a strip attached to said second extension member attachment location.

34. The attachment of claim 33 wherein said strip has adhesive properties.

35. The attachment of claim 33 wherein said strip is formed from a piece of tape.

36. The attachment of claim 29 wherein said first orientation member attachment location further comprises at least one structural protrusion formed thereon for enabling a locking means to securely position said plate in it's coplanar positions.

37. The attachment of claim 29 wherein said attachment is formed from one piece of material and said pivotal attachment means are formed in the material.

38. The attachment of claim 29 wherein said attachment is formed from one piece of material and said pivotal attachment means are formed as hinged folds in the material.

39. The attachment of claim 29 wherein said attachment is formed from at least two pieces of material.

40. The attachment of claim 29 wherein said plate of said attachment further comprises a pocket.

41. The attachment of claim 29 wherein said plate further comprises an array of at least one stack of repositionable notes.

42. The attachment of claim 29 wherein said plate further comprises an electronic device.

43. An attachment for a book, said book having at least one coupling location, said attachment comprising:

a mounting plate, having a mounting face for receiving a second plate thereon, and perimeter features including at least one edge, a second plate having a top face, a bottom face, and perimeter features with at least two opposing edges, an orientation member having opposing attachment locations defining first and second orientation member attachment locations, and an extension member having at least a first and a second attachment location, said extension member further comprising coupling means at said second extension member attachment location for allowing said extension member to be removed from and subsequently reinserted into said book at said book coupling location; wherein:

said orientation member first attachment location is pivotally attached to said mounting plate at said at least one edge of said mounting plate, and said orientation member second attachment location is pivotally attached to said extension member at said extension member first attachment location; and, said mounting plate face is attached to said bottom face of said second plate, with said at least one edge lying between said at least two opposing edges of said second plate, such that:

when said extension member second attachment location is coupled to said book at said book coupling location, said second plate may be placed in any one of at least two substantially adjacent, coplanar positions to either side of said first extension member attachment location, with preservation of orientation of said second plate top face and perimeter features in both positions.

44. The attachment of claim 43 wherein said coupling means is an insertable hook structure.

45. The attachment of claim 43 wherein said coupling means is a set of holes for placement in a ring binding.

46. The attachment of claim 43 wherein said coupling means is a set of holes, where each hole further comprises a cutout for the insertion and deinsertion of the hole on a closed ring binding.

47. The attachment of claim 43 wherein said coupling means is a strip attached to said second extension member attachment location.

48. The attachment of claim 47 wherein said strip has adhesive properties.

49. The attachment of claim 47 wherein said strip is formed from a piece of tape.

50. The attachment of claim 43 wherein said first orientation member attachment location further comprises at least one structural protrusion formed thereon.

51. The attachment of claim 43 wherein said attachment is formed from one piece of material and said pivotal attachment means are formed in the material.

52. The attachment of claim 43 wherein said attachment is formed from one piece of material and said pivotal attachment means are formed as hinged folds in the material.

53. The attachment of claim 43 wherein said attachment is formed from at least two pieces of material.

54. The attachment of claim 43 wherein said mounting plate of said attachment further comprises a pocket.

55. The attachment of claim 43 wherein said second plate of said attachment further comprises an array of at least one stack of repositionable notes.

56. The attachment of claim 43 wherein said second plate further comprises an electronic device.

* * * * *